US012773589B2

(12) United States Patent
Chamberlain et al.

(10) Patent No.: US 12,773,589 B2
(45) Date of Patent: Oct. 27, 2026

(54) ASYMMETRICAL RESISTANCE SYSTEMS AND METHODS FOR EXERCISE EQUIPMENT

(71) Applicant: Peloton Interactive, Inc., New York, NY (US)

(72) Inventors: Jason L. Chamberlain, Gilroy, CA (US); John Wattleworth, Saint Peter, MN (US)

(73) Assignee: Peloton Interactive, Inc., New York, NY (US)

( * ) Notice: Subject to any disclaimer, the term of this patent is extended or adjusted under 35 U.S.C. 154(b) by 13 days.

(21) Appl. No.: 18/805,426

(22) Filed: Aug. 14, 2024

(65) Prior Publication Data

US 2024/0408431 A1 Dec. 12, 2024

Related U.S. Application Data

(63) Continuation of application No. PCT/US2023/012545, filed on Feb. 7, 2023.

(60) Provisional application No. 63/311,025, filed on Feb. 16, 2022.

(51) Int. Cl.
*A63B 21/00* (2006.01)
*A63B 21/22* (2006.01)

(52) U.S. Cl.
CPC .. *A63B 21/00192* (2013.01); *A63B 21/00069* (2013.01); *A63B 21/225* (2013.01)

(58) Field of Classification Search
CPC ..... A63B 21/00192; A63B 21/00069; A63B 21/225; A63B 21/0051; A63B 22/0605; A63B 2024/0093; A63B 24/0087; A63B 2071/0625; A63B 71/0622; A63B 2230/062; A63B 2230/755; A63B 21/00072; A63B 2209/08; A63B 2230/405

See application file for complete search history.

(56) References Cited

U.S. PATENT DOCUMENTS 4,977,794 A * 12/1990 Metcalf ..... F16F 15/30 482/63
2014/0113779 A1 4/2014 Loach

FOREIGN PATENT DOCUMENTS

CN 100359783 C 1/2008
EP 3341092 A1 7/2018
EP 3341092 B1 * 7/2021 ..... A63B 21/225

* cited by examiner

*Primary Examiner* — Sundhara M Ganesan
(74) *Attorney, Agent, or Firm* — Haynes and Boone, LLP

(57) ABSTRACT

Asymmetrical resistance systems and methods include an asymmetrical flywheel having a braking track disposed on a first side of the flywheel, and a resistance apparatus comprising at least one magnet, wherein a distance between the magnet and the braking track corresponds to a force resisting rotation of the flywheel. The flywheel includes an outer portion comprising a ferromagnetic material, and the resistance apparatus includes a backing plate disposed on a side of the magnets opposite the braking track. A magnetic field flows from a first magnet to the outer portion of the flywheel through the braking track, back through the braking track to the second magnet, and from the second magnet through the backing plate to the first magnet. While the flywheel is rotating, the braking track moves through the magnetic field creating an eddy current that generates a force resistant to the rotation of the asymmetrical flywheel.

20 Claims, 19 Drawing Sheets

(Side View)

(Side View)

(Front Perspective View)

(Rear Perspective View)

(Bottom View)

(Rear View)

(Top View)

(Front View)

(Side Cross-Section View)

(Side Cross-Section View)

(Top View)

(Front Perspective View)

(Side View)

(Front View)

(Rear View)

(Front Perspective View)

(Rear Perspective View)

(Bottom View)

(Top View)

(Front View)

(Rear View)

(Side View)

(Top View)

(Bottom View)

(Side View)

(Rear View)

(Front View)

(Rear Perspective View)

(Front Perspective View)

ASYMMETRICAL RESISTANCE SYSTEMS AND METHODS FOR EXERCISE EQUIPMENT

CROSS-REFERENCE TO RELATED APPLICATIONS

This application is a continuation of International Patent Application No. PCT/US2023/012545 filed Feb. 7, 2023 and entitled "ASYMMETRICAL RESISTANCE SYSTEMS AND METHODS FOR EXERCISE EQUIPMENT," which claims priority to U.S. Provisional Patent Application No. 63/311,025, filed Feb. 16, 2022, and entitled "ASYMMETRICAL RESISTANCE SYSTEMS AND METHODS FOR EXERCISE EQUIPMENT," all of which are incorporated herein by reference in their entirety.

TECHNICAL FIELD

The present application relates generally to the field of exercise equipment and methods, and more specifically to systems and methods for applying and/or adjusting resistance in exercise equipment.

BACKGROUND

Many modern exercise systems allow a user to adjust the exercise intensity and/or other exercise settings according to personal training goals. For example, an exercise cycle, such as a spin bike, may be configured with a resistance adjusting mechanism, allowing a user to adjust the pedal resistance by adjusting a degree of resistance applied to a spinning flywheel. The resistance adjustment can interfere with the exercise session if the user is distracted by sudden changes to the resistance during adjustment or if the resistance applied doesn't provide a smooth feel to the user. For manufacturers of exercise equipment, these user concerns are balanced by other considerations including simplicity of design, low cost of parts and assembly, calibration, flexibility of design, and the product's durability after heavy use.

In view of the foregoing, there is a continued need for improved resistance systems and methods for use with exercise equipment that increases the convenience to the user, enhances the exercise experience, and provides various design flexibility and cost advantages.

SUMMARY

In various embodiments of the present disclosure, asymmetrical resistance systems and methods include a flywheel having a braking track disposed on a first side of the flywheel, and a resistance apparatus comprising at least one magnet adapted to selective move relative to the braking track to generate a magnetic force that resists the rotation of the flywheel.

In some embodiments, a resistance system for an exercise apparatus includes a flywheel rotatably mounted to the exercise apparatus, the flywheel having an outer portion adjacent to a perimeter of the flywheel, the outer portion comprising a first ferromagnetic material (e.g., material with high magnetic permeability such as steel). The outer portion of the flywheel may also be constructed with a high-density material (e.g., steel) with sufficient mass for generating rotational inertia as the flywheel rotates. A braking track is disposed on a first side of the flywheel adjacent to the outer portion and is made from a material having higher conductivity than the first ferromagnetic material. A resistance apparatus includes at least one magnet having a front side adapted to face the braking track when the resistance apparatus is in a first position, and a backing plate made from a ferromagnetic material (e.g., material with high magnetic permeability such as steel) that is disposed on a second side of the at least one magnet, opposite the braking track when the resistance apparatus is in the first position. A distance between the at least one magnet and the braking track corresponds to a force that resists the rotation of the flywheel.

A magnetic field flows from a first magnet to the outer portion of the flywheel through the braking track, back through the braking track to the second magnet, and from the second magnet through the backing plate and to the first magnet. The braking track of a spinning flywheel moves through the magnetic field and creates an eddy current that applies a force that resists the direction of rotation of the flywheel.

The scope of the present disclosure is defined by the claims, which are incorporated into this section by reference. A more complete understanding will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Aspects of the disclosure and their advantages can be better understood with reference to the following drawings and the detailed description that follows. It should be appreciated that like reference numerals are used to identify like elements illustrated in one or more of the figures, wherein showings therein are for purposes of illustrating embodiments of the present disclosure and not for purposes of limiting the same. The components in the drawings are not necessarily to scale, emphasis instead being placed upon clearly illustrating the principles of the present disclosure.

DETAILED DESCRIPTION

Figure 1A:
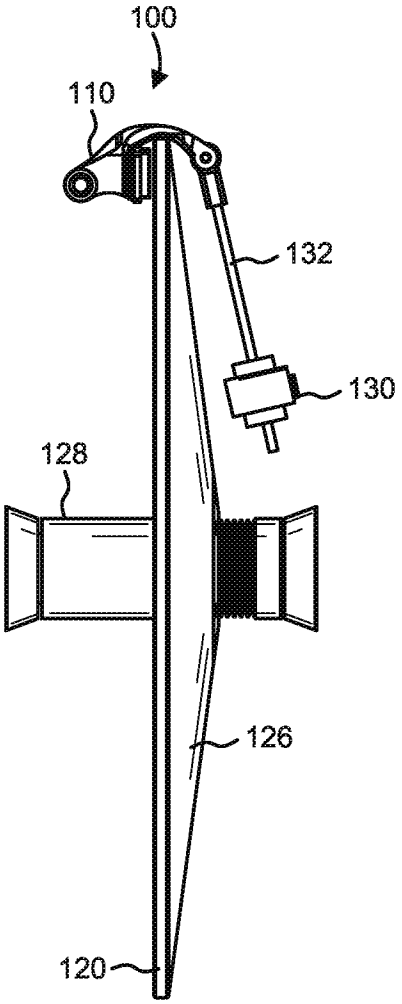
FIG. 1A is a side view of an asymmetrical resistance system, in accordance with one or more embodiments of the present disclosure.
Figure 1B:
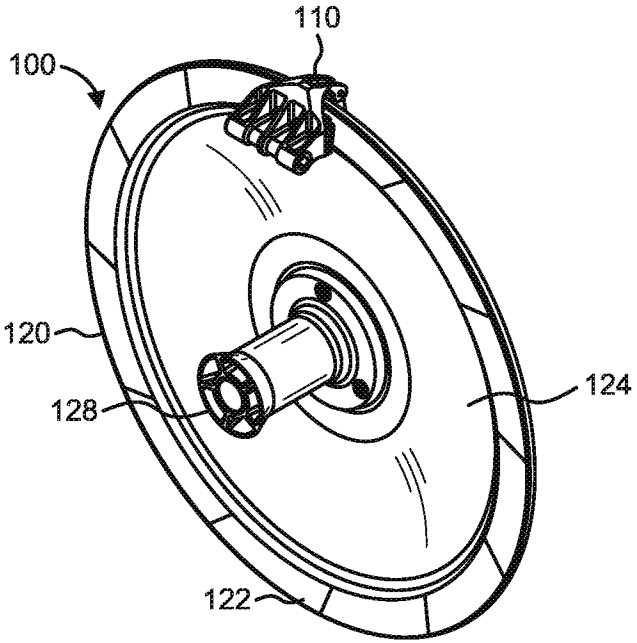
FIG. 1B is a front perspective view of an asymmetrical resistance system, in accordance with one or more embodiments of the present disclosure.
Figure 1C:
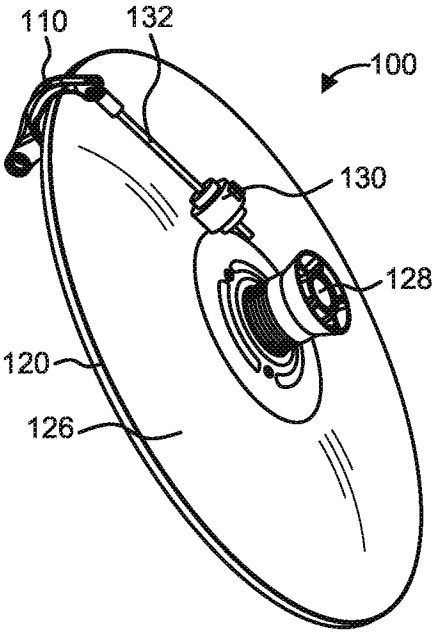
FIG. 1C is a rear perspective view of an asymmetrical resistance system, in accordance with one or more embodiments of the present disclosure.
Figure 1E:
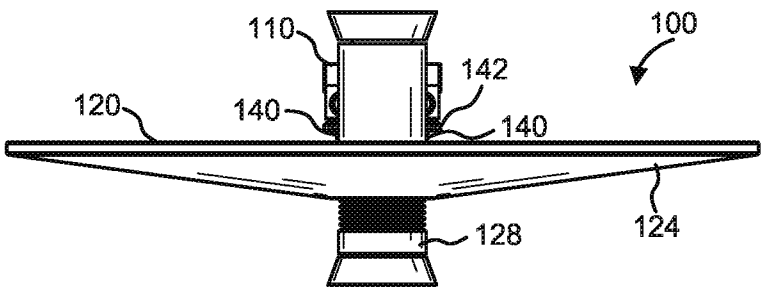
FIG. 1E is a bottom view of an asymmetrical resistance system, in accordance with one or more embodiments of the present disclosure.
Figure 1G:
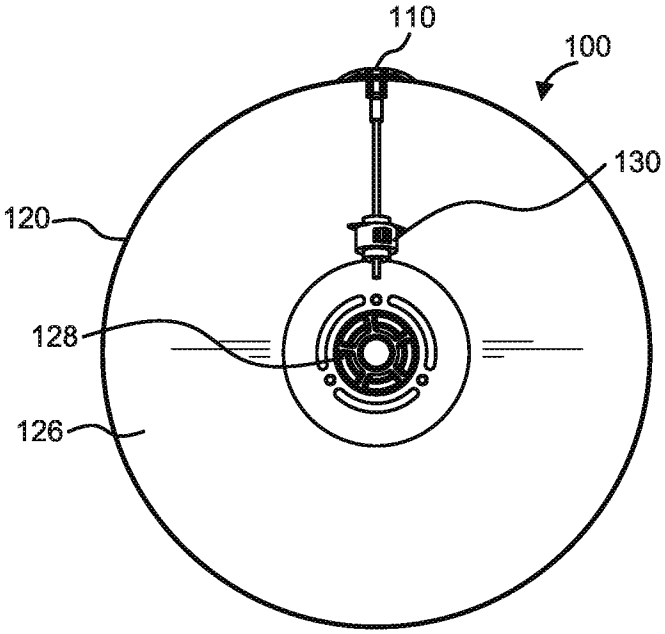
FIG. 1G is a rear view of an asymmetrical resistance system, in accordance with one or more embodiments of the present disclosure.
Figure 1D:
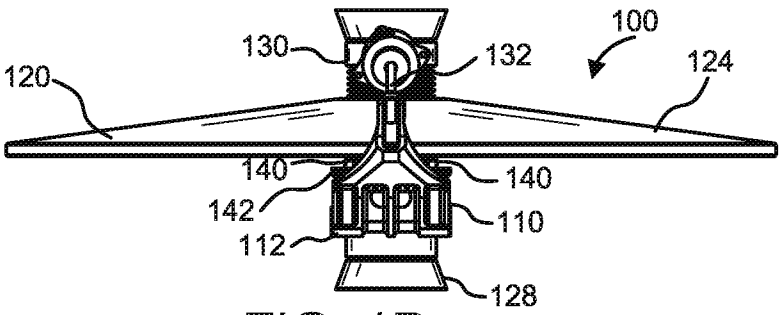
FIG. 1D is a top view of an asymmetrical resistance system, in accordance with one or more embodiments of the present disclosure.
Figure 1F:
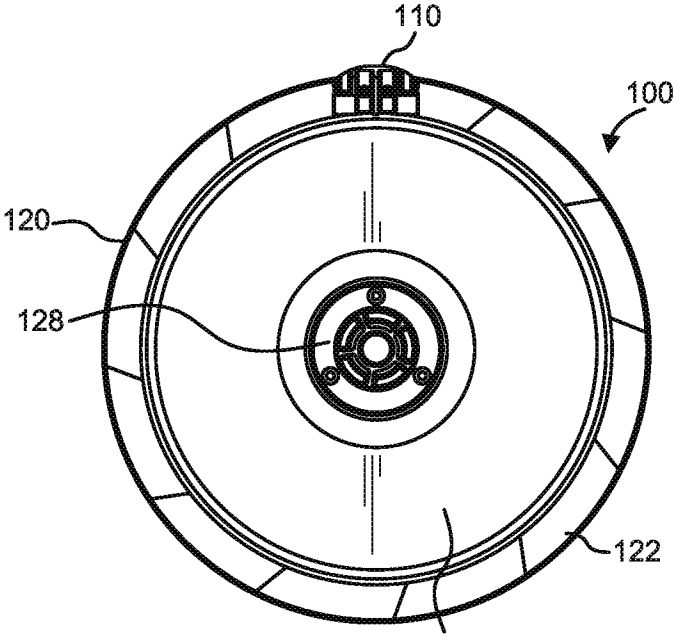
FIG. 1F is a front view of an asymmetrical resistance system, in accordance with one or more embodiments of the present disclosure.
Figure 1I:
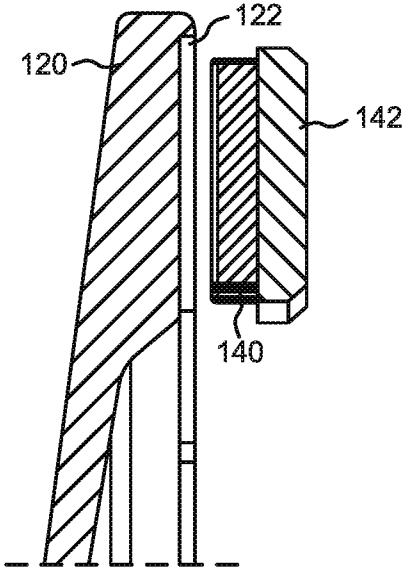
FIG. 1I is a side, cross-section view of an asymmetrical resistance system illustrating a relationship between a flywheel and an assembly including magnet(s) and a backing plate, in accordance with one or more embodiments of the present disclosure.
Figure 1H:
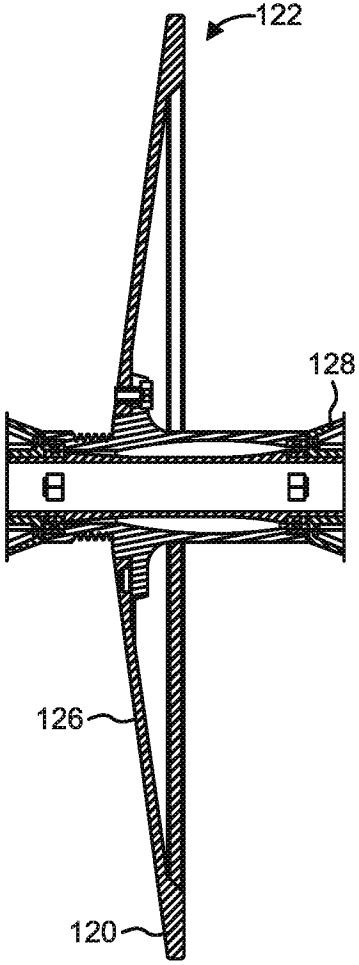
FIG. 1H is a side, cross-section view of an asymmetrical resistance system, in accordance with one or more embodiments of the present disclosure.
Figure 1J:
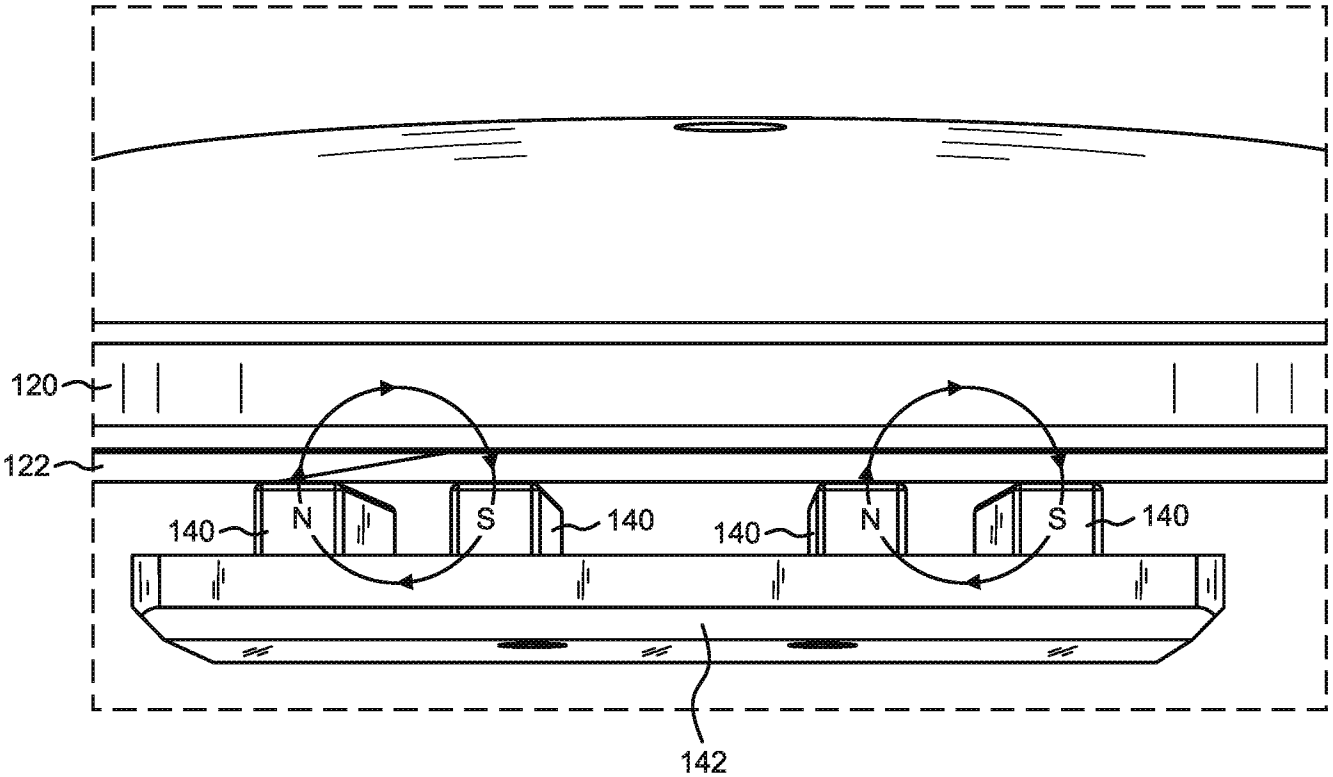
FIG. 1J is a top view of an asymmetrical resistance system illustrating aspects of magnet flux, in accordance with one or more embodiments of the present disclosure.
Figure 2A:
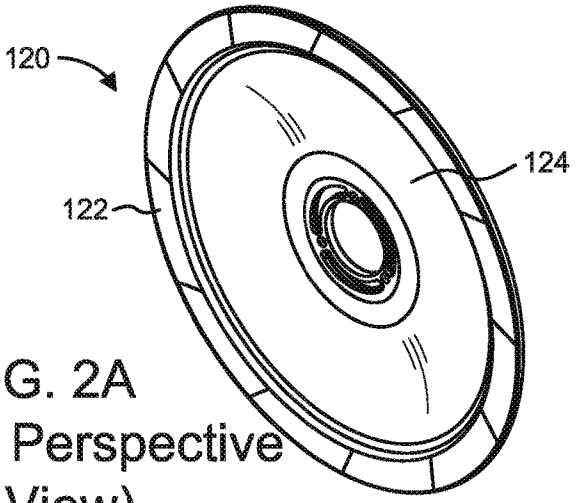
FIG. 2A is a front perspective view of a flywheel of an asymmetrical resistance system, in accordance with one or more embodiments of the present disclosure.
Figure 2B:
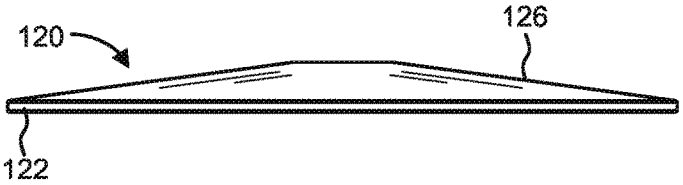
FIG. 2B is a side view of a flywheel of an asymmetrical resistance system, in accordance with one or more embodiments of the present disclosure.
Figure 2C:
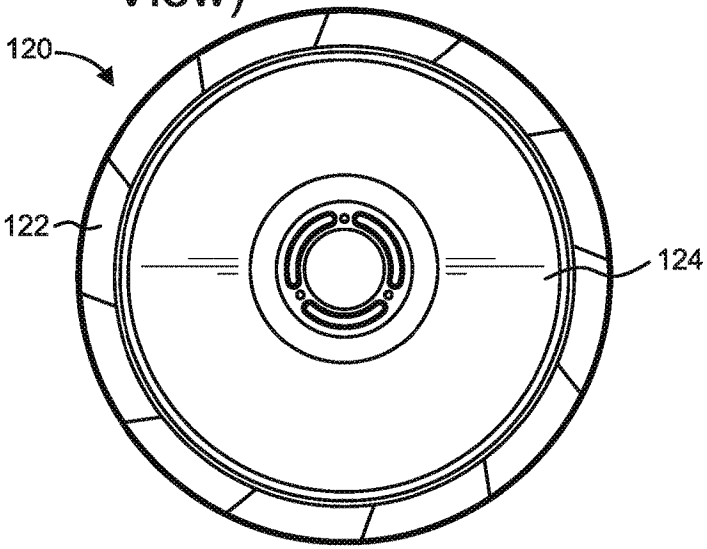
FIG. 2C is a front view of a flywheel of an asymmetrical resistance system, in accordance with one or more embodiments of the present disclosure.
Figure 2D:
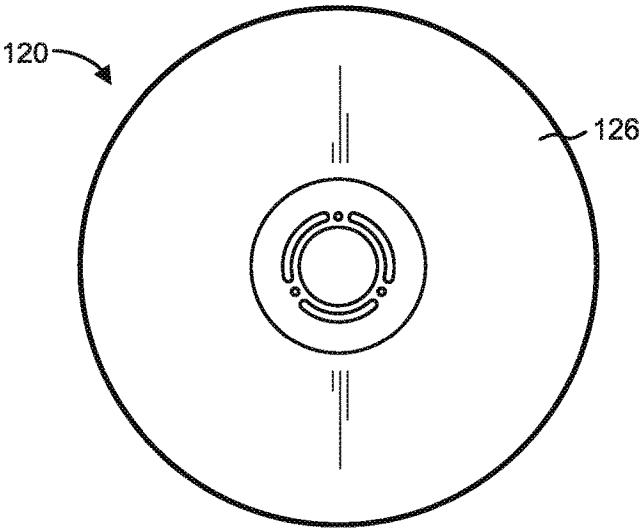
FIG. 2D is a rear view of a flywheel of an asymmetrical resistance system, in accordance with one or more embodiments of the present disclosure.

The present disclosure provides novel systems and methods for adjusting resistance in exercise equipment. In various embodiments, an asymmetrical braking system for a flywheel of an exercise apparatus (e.g., an exercise cycle, a rowing machine, etc.) includes at least one magnet providing varying exercise resistance when moved in relation to the flywheel. The asymmetrical braking systems disclosed herein provide an easy to use and accurate resistance adjustment assembly for changing exercise intensity during operation. The asymmetrical braking system may be used with a control system to smoothly adjust the resistance during operation and to sense and/or derive power, cadence, resistance, and other values for use by the exercise apparatus and display to the user.

Referring to FIGS. 1A-J, example embodiments of the present disclosure will now be described. A resistance system 100 includes a resistance apparatus 110 configured to adjust the resistance applied to a rotating flywheel 120 of an exercise apparatus. An electrically driven actuator 130 may be provided to move the resistance apparatus 110 towards and/or away from the flywheel 120 to adjust the resistance applied to the flywheel 120. In other embodiments, a manual adjustment mechanism (e.g., a manually rotatable knob) and/or other resistance adjusting mechanisms may be used to adjust the resistance apparatus during operation.

The resistance apparatus 110 includes an arm 112 attached to the actuator 130 via a shaft 132, enabling movement of the resistance apparatus 110 in relation to the flywheel 120. The arm 112 is adapted to hold two or more magnets 140 and a backing plate 142, which are selected and arranged such that, as the magnets 140 move closer to or away from an outer portion of the flywheel 120 comprising a braking track 122, the amount of force resisting the rotation of the flywheel 120 can be adjusted from a maximum level to a minimum level in accordance with design parameters of the exercise apparatus (e.g., from maximum resistance to no resistance). In some embodiments, the flywheel 120 is constructed of a ferromagnetic material that has high magnetic permeability (e.g., steel, iron, nickel, etc.) and includes a braking track 122 to generate resistive forces while rotating through the magnetic field generated by the magnets 140. In some embodiments, the braking track 122 of the flywheel 120 may comprise a material with higher electrical conductivity than the ferromagnetic material in the outer portion of the flywheel to increase resistance to the direction of rotation for the same air gap (e.g., the distance between the magnets and the flywheel). In various embodiment, the braking track 122 may comprise, for example, aluminum, copper or other material to generate greater forces that resist rotation of the flywheel 120 over the ferromagnetic material of the outer portion, alone. In some embodiments, for example, the flywheel comprises steel and the braking track comprises aluminum or copper.

In operation, the flywheel 120 is adapted to rotate about a hub 128 in response to user movement. In an exercise cycle, for example, the flywheel is adapted to spin in response to a user operating pedals of the cycle with the user's feet. In a rowing machine, for example, the flywheel is adapted to rotate in response to a user pulling on a bar connected to the flywheel via a cable. As illustrated, the braking track 122 forms a plane that is perpendicular to the axis of rotation and arranged to pass in front of the magnets 140 in a uniform fashion while the flywheel spins. In various embodiments, the flywheel may be a solid disk, have a rim-spoke arrangement with the spokes connecting the rim to the hub, or other flywheel configuration. The asymmetrical resistance systems and methods disclosed herein can also be used with asymmetrical flywheel designs. In the illustrated embodiment, for example, the flywheel 120 includes a concave inner portion 124 with a hole formed at the center (e.g., at the vertex of a substantially cone-shaped flywheel) for receiving and attaching to the hub 128. Similarly, when viewed from the rear the flywheel 120 forms a convex surface 126 that extends to the perimeter of the flywheel 120. In various embodiments, the convex surface 126 may extend from the outer edge of the flywheel 120, the outer edge of the braking track 122, the inner edge of the braking track 122, or some point in between the outer and inner edges.

In some embodiments, the actuator 130 is a stepper motor, such as a stepper motor attached to a frame of the exercise apparatus, allowing a threaded shaft 132 to be driven up/down by the stepper motor relative to the flywheel. The shaft 132 has a first end pivotably attached to the resistance apparatus 110 (e.g., to a portion of the arm 112) and a second end that extends through the stepper motor. As a result, the magnets 140 are selectively moved up and down by the stepper motor/threaded shaft relative to the flywheel 120 to adjust the resistance. It will be appreciated that other assemblies, motors, parts and/or arrangements may be used to adjust the position of the magnets 140 during operation, such as described herein in FIGS. 8A-J.

In some embodiments, a control system of the exercise apparatus tracks the position of the magnets 140 relative to the flywheel 120 and/or the applied resistance. For example, the control system may be calibrated to track the position of the magnets 140 based on movement of the actuator 130. In another implementation, the exercise apparatus may include one or more sensors to measure the position of the magnets 140 and/or resistance apparatus 110, and/or measure the resistance being applied (e.g., a load cell positioned in the resistance apparatus 110 to measure lateral forces applied as the flywheel 120 spins underneath). In order to calculate the resistance applied to the user, the product of the applied force, and the distance from the center of the flywheel will yield the torque applied to the flywheel. The rotational speed of the flywheel may also be measured using one or more sensors (e.g., using one or more sensors to measure RPMs). The power absorbed by the resistance apparatus may be calculated as a function of shaft torque and speed.

Figure 9:
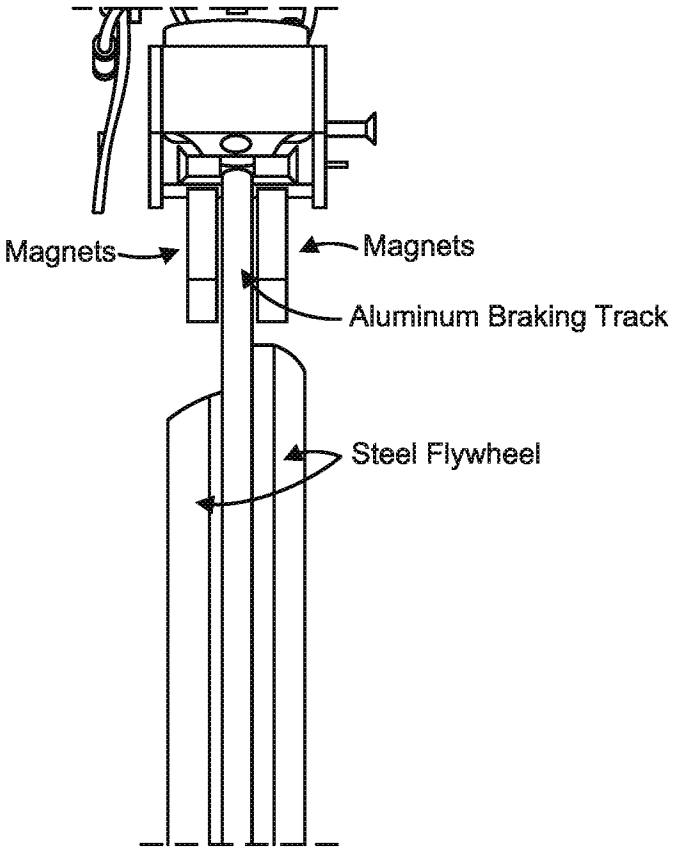
FIG. 9 (Prior Art)
FIG. 9 illustrates an example conventional braking system.

The embodiments described herein provide numerous advantages over conventional systems. An example conventional system is illustrated in FIG. 9, and includes a flywheel, an aluminum track that extends beyond the flywheel, and a pairs of magnets on opposite sides of the aluminum track to provide resistance against rotation of the flywheel. The present system is lighter, uses fewer parts and is potentially more cost efficient than conventional approaches.

In one embodiment of the present disclosure, the outer portion of the flywheel comprises a dense material (e.g., steel), which provides effective inertia with less total mass of conventional flywheels by adding steel to the outermost diameter of the flywheel, to or beyond the aluminum braking track. In the illustrated embodiment, this provides a more effective use of the weight of the steel as it contributes to inertia. By extending the steel portion of the flywheel to/past the braking track, steel from the center of the flywheel can be removed, making more efficient use of the steel at the perimeter. Thus, the embodiments disclosed herein can generate the same inertia with less weight and lower material cost. In various embodiments, the flywheel may be cast as a single piece of steel with thicker portion at the perimeter and thinner portion towards the center. In other embodiments, the inner portions may be constructed of other materials that provide the support necessary for the outer portions, or comprise spokes or other arrangements for connecting the hub to the outer portion of the flywheel. The outer portions may comprise steel or other heavy material that provides effective inertia, while also contributing to the magnetic braking as disclosed herein.

In various embodiments, the flywheel includes a braking track on only one side of the flywheel—the side of the flywheel facing the magnets—at the outer portion of the flywheel backed by the ferromagnetic material. The thickness of the outer portion of the flywheel is selected to provide a sufficient cross-section (height and width) of the ferromagnetic material for the magnetic flux to travel through to provide a contactless force that resists the rotation of the flywheel (e.g., a thickness of at least 5-6 millimeters in some embodiments) and to generate sufficient inertia for use in the exercise apparatus (e.g., 8-10 millimeters thick may be sufficient at the outer diameter for some embodiments). The inner portion of the flywheel may be thinner to save on cost and reduce weight (e.g., 3 millimeters may be sufficient for many implementations).

In operation, the magnets 140 generate a field that extends to the rotating flywheel 120 when the resistance apparatus is moved in proximity to the braking track. The magnetic flux travels from the positive end of one magnet to the negative end of another magnet. The magnetic flux travels through the braking track 122 of the rotating flywheel 120 into the ferromagnetic material, generating an eddy current resulting in a force that resists rotation of the braking track of the flywheel. The amount of force generated is a function of the selected materials, the specifications of the flywheel and magnets, the rotational speed of the flywheel, the position of the magnets relative to the braking track, and other factors.

In one example, a rotating flywheel with a steel outer portion and aluminum braking track rotates through the magnetic fields generated by the magnets. The steel attracts the magnetic flux from the magnets, creating the force that resists rotation of the flywheel. In conventional systems, there is a magnet on each side of the flywheel and the magnetic flux flows from one magnet to another magnet on the other side of the flywheel. By contrast, embodiments of the present disclosure include the ferromagnetic portion that functions to receive the magnetic flux from the magnets on only one side, allowing the magnets on the other side to be removed. This arrangement further enables increased weight at the outer diameter of the flywheel to increase inertia at a lower overall weight of the flywheel.

The braking track may be relatively thin (e.g., 1.5-2 mm) with a diameter that encompasses the face of the magnet. For example, a 20-30 mm wide braking track has shown to be sufficient in practice with magnets that are approximately one inch tall. In this embodiment, the face of the magnet fits within the width of the aluminum with some extra aluminum to capture magnetic flux which extends beyond the face of the magnet. An aluminum braking track that is wider than the magnet can result in greater resistance. It will be appreciated by those skilled in the art that other dimensions and arrangements for the braking track may be selected as appropriate for a particular exercise apparatus.

In the illustrated embodiment, the steel outer portion acts as a magnetic backing plate. The braking track may be aluminum, copper or other high conductivity material (e.g., a material having a conductivity greater than the material of the outer portion) to provide increased eddy current resistance over the flywheel itself. As an alternative to steel, other magnetic material (e.g., iron, alloy) may be used. However, steel provides both the weight for the flywheel inertia and magnetic properties providing a backing for the asymmetrical flywheel design described herein.

The magnetic flux passes through the braking track and the ferromagnetic outer portion and returns it back to the magnets. In one arrangement, the magnets include an array of magnets with alternating polarity orientation. In the illustrated embodiment, pairs of magnets may be used such that flux from a positive magnet passes through the braking track and ferromagnetic material and returns to the negative magnet. To complete the loop, a backing plate 142 is also provided on the side of the magnets opposite the braking track. As the flywheel spins, the generated eddy current provides resistance to the rotation of the flywheel. For illustrative purposes, the flux travels in a circle, from the positive magnet to the ferromagnetic material through the braking track, back to the negative magnet out to the backing plate 142 and into the positive magnet again. It will be appreciated that other magnet arrangements (e.g., one magnet, a pair of magnets, two or more pairs of magnets, etc.) may be used in accordance with the teachings of the present disclosure.

In various embodiments, the backing track could be continuous, segmented to potentially reduce cost or simplify assembly, or embodied in another arrangement that provides sufficient resistance to the rotation of the flywheel. In some arrangements, a segmented braking track can be used with minimal reduction in resistance as compared to a single continuous track. In various embodiments, the braking track may be attached to the flywheel through glue, tape, screws, rivets, or other attachment material or device as known in the art.

One effect of an asymmetrical resistance apparatus with magnets on only one side is that the magnets pull may operate to pull the flywheel laterally to one side. In the illustrated embodiments, the flywheel 120 is constructed to counteract lateral forces from the asymmetrical magnets. Referring to FIGS. 2A-D, the flywheel 120 in the illustrated embodiment is substantially cone-shaped to counteract the magnets and mitigate the pulling of the flywheel to the side. The shape of the flywheel provides additional lateral support to remain fixed even with the pull of the magnets. The stability of the flywheel allows for improved control of the airgap between the braking track and the magnets. In operation, it is often desirable to move the magnets as close as possible to the aluminum braking track, without contact between the magnets and the aluminum, to improve resistance. In test implementations, an airgap of 1-2 millimeters has been sufficient to avoid touching while providing effective resistance.

Figure 3:
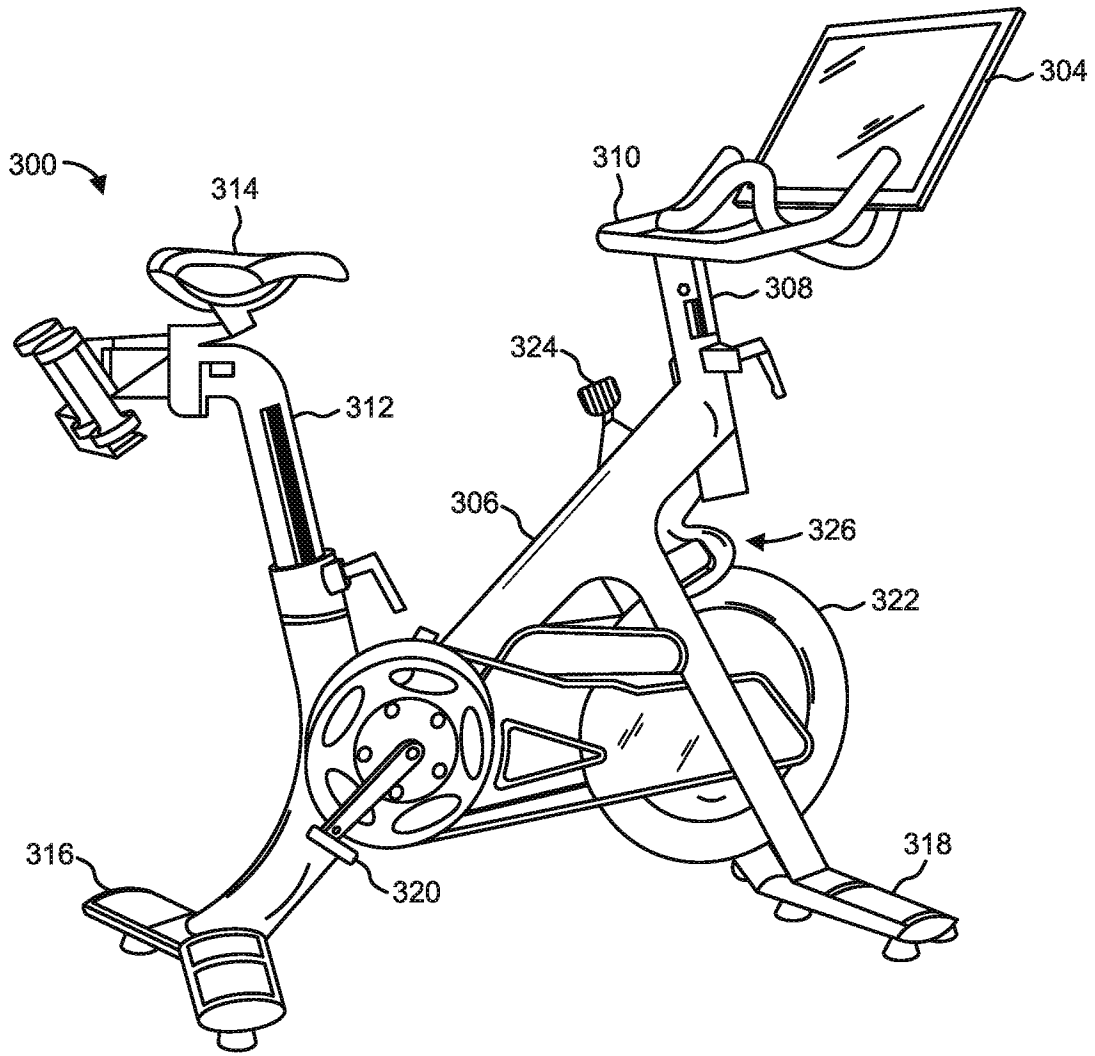
FIG. 3 is an example exercise apparatus configured with an asymmetrical resistance system, in accordance with one or more embodiments of the present disclosure.
Figure 4B:
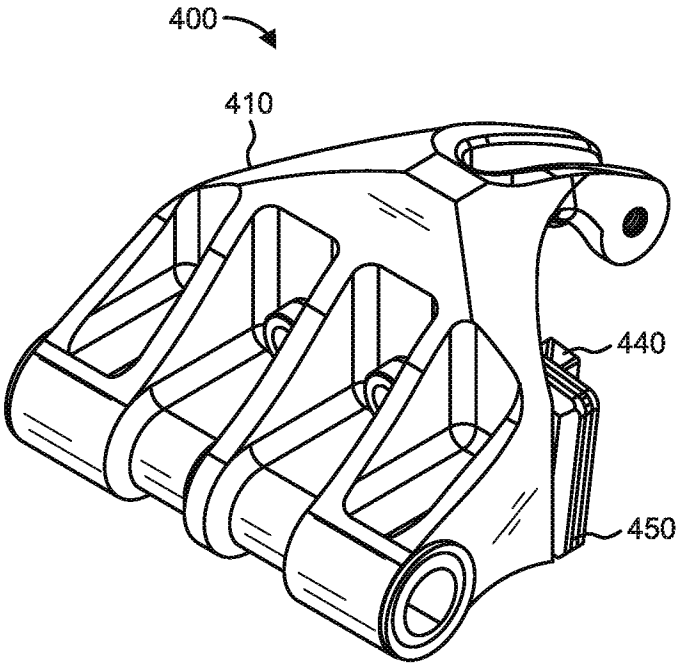
FIG. 4B is a front perspective view of an asymmetrical resistance apparatus, in accordance with one or more embodiments of the present disclosure.
Figure 4A:
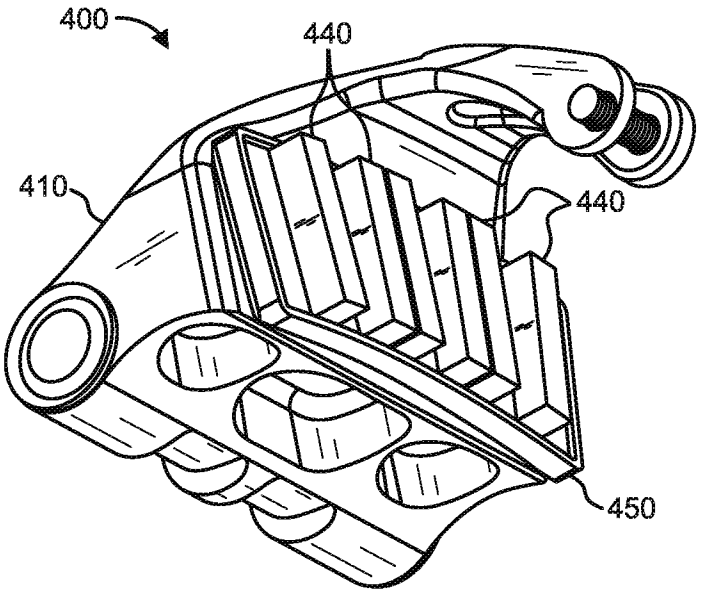
FIG. 4A is a rear perspective view of an asymmetrical resistance apparatus, in accordance with one or more embodiments of the present disclosure.
Figure 4D:
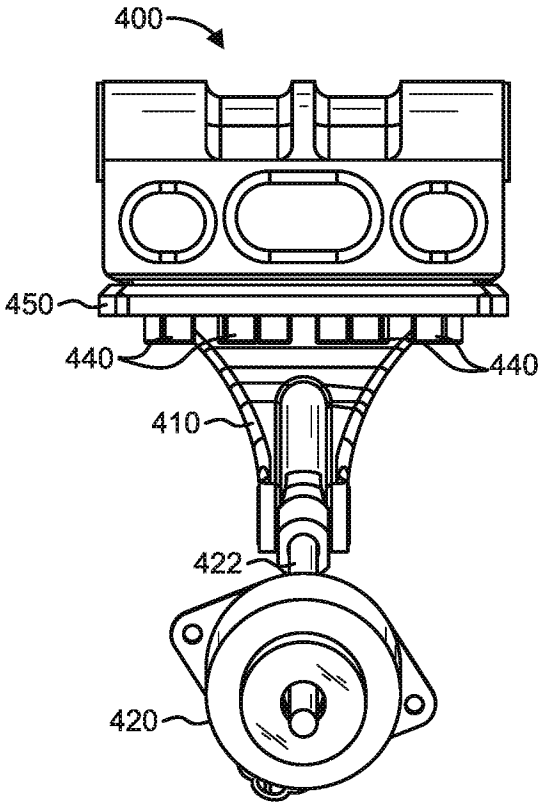
FIG. 4D is a bottom view of an asymmetrical resistance apparatus, in accordance with one or more embodiments of the present disclosure.
Figure 4C:
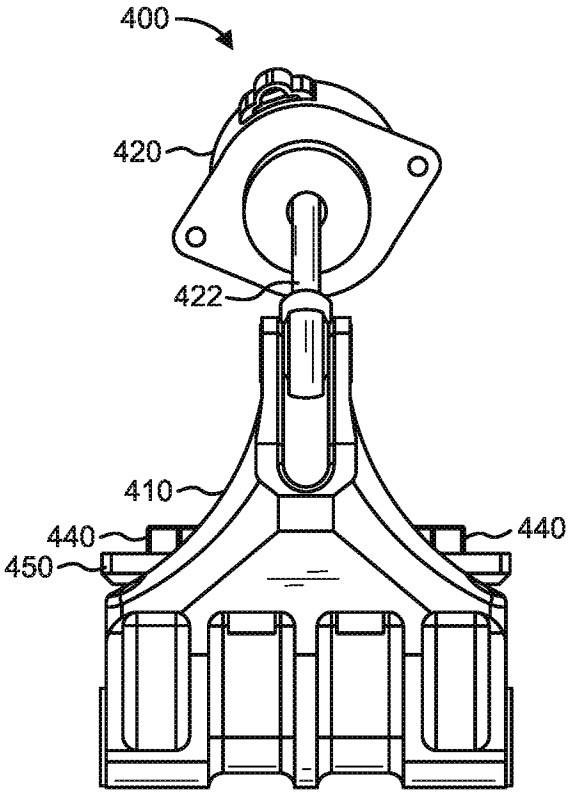
FIG. 4C is a top view of an asymmetrical resistance apparatus, in accordance with one or more embodiments of the present disclosure.
Figure 4G:
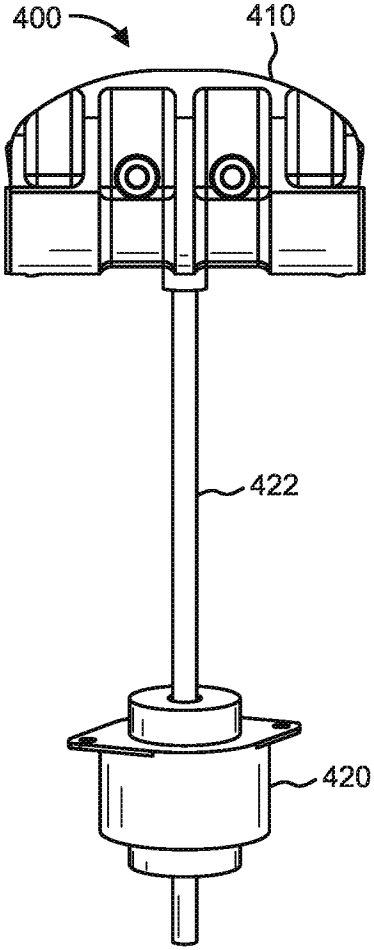
FIG. 4G is a front view of an asymmetrical resistance apparatus, in accordance with one or more embodiments of the present disclosure.
Figure 4F:
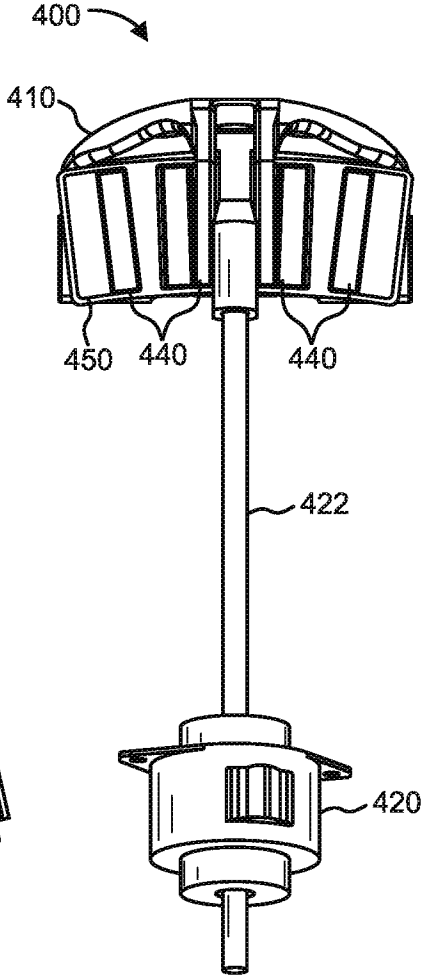
FIG. 4F is a rear view of an asymmetrical resistance apparatus, in accordance with one or more embodiments of the present disclosure.
Figure 4E:
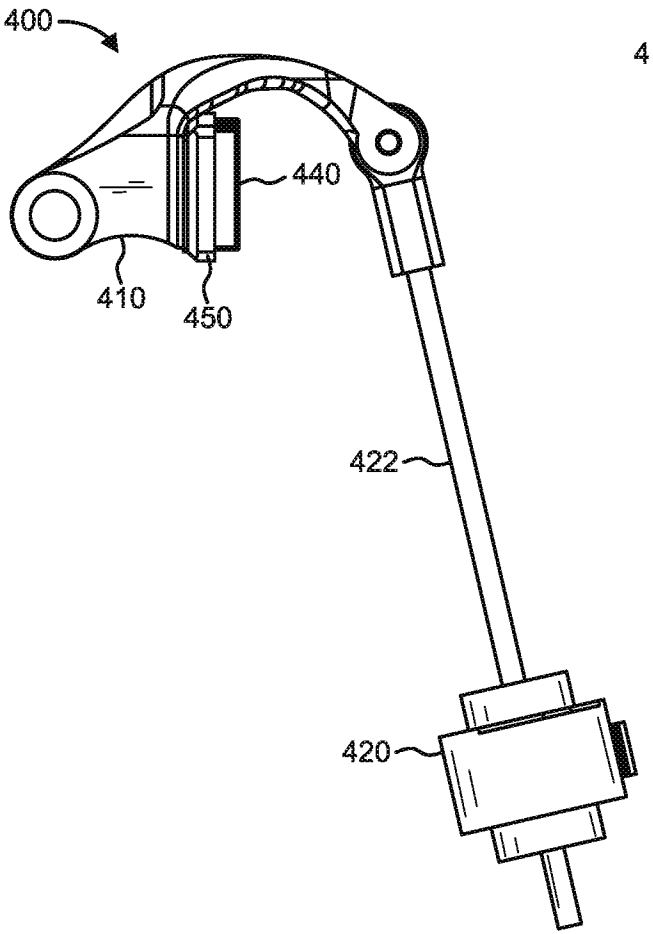
FIG. 4E is a side view of an asymmetrical resistance apparatus, in accordance with one or more embodiments of the present disclosure.

Referring to FIG. 3, an example exercise apparatus is shown in accordance with one or more embodiments of the present disclosure. As shown, a stationary bike 300 includes integrated or connected digital hardware including at least one display screen 304. The stationary bike 300 may include a frame 306, a handlebar post 308 to support handlebars 310, a seat post 312 to support the seat 314, a rear support 316 and a front support 318. Pedals 320 are used to drive a flywheel 322 (e.g., flywheel 120 as described herein) via a belt, chain, or other drive mechanism. In various example embodiments, the force on the pedals 320 necessary to spin the flywheel 322 can be adjusted using an available electrical and/or manual control, such as an interactive display (e.g., display screen 304), a resistance adjustment knob 324, or other control which adjusts a resistance mechanism 326 (e.g., the resistance adjusting mechanism of FIGS. 1A-1J). The resistance adjustment knob 324 may rotate an adjustment shaft to control the resistance mechanism 326 to increase or decrease the resistance of the flywheel 322 to rotation. For example, rotating the resistance adjustment knob clockwise may cause a set of magnets of the resistance mechanism 326 to move relative to the flywheel 322, increasing its resistance to rotation and increasing the force that the user must apply to the pedals 320 to make the flywheel 322 spin.

The stationary bike 300 may also include various features that allow for adjustment of the position of the seat 314, handlebars 310, etc. In various example embodiments, the display screen 304 may be mounted in front of the user forward of the handlebars. Such display screen may include a hinge or other mechanism to allow for adjustment of the position or orientation of the display screen relative to the rider.

The digital hardware associated with the stationary bike 300 may be connected to or integrated with the stationary bike 300 (e.g., via display screen 304), or it may be located remotely and wirelessly connected to the stationary bike 300. The digital hardware may be integrated with a display screen 304 which may be attached to the stationary bike, or it may be mounted separately in a positioned in the line of sight of a person using the stationary bike. The digital hardware may include digital storage, processing, and communications hardware, software, and/or one or more media input/output devices such as display screens, cameras, microphones, keyboards, touchscreens, headsets, and/or audio speakers. In various example embodiments these components may be integrated with the stationary bike. All communications between and among such components may be multichannel, multi-directional, and wireless or wired, using any appropriate protocol or technology. In various example embodiments, the system may include associated mobile and web-based application programs that provide access to account, performance, and other relevant information to users from local or remote personal computers, laptops, mobile devices, or any other digital device.

In various example embodiments, the stationary bike 300 is equipped with various sensors that can measure a range of performance metrics from both the stationary bike and the rider, instantaneously and/or over time. For example, the resistance mechanism 326 may include sensors providing resistance feedback on the position of the resistance mechanism. The stationary bike 300 may also include power measurement sensors such as magnetic resistance power measurement sensors or an eddy current power monitoring system that provides continuous power measurement during use. The stationary bike 300 may also include a wide range of other sensors to measure speed, pedal cadence, flywheel rotational speed, etc. The stationary bike may also include sensors to measure rider heart-rate, respiration, hydration, or any other physical characteristic. Such sensors may communicate with storage and processing systems on the bike, nearby, or at a remote location, using wired or wireless connections.

Hardware and software within the sensors or in a separate processing system may be provided to calculate and store a wide range of status and performance information. Relevant performance metrics that may be measured or calculated include resistance, distance, speed, power, total work, pedal cadence, heart rate, respiration, hydration, calorie burn, and/or any custom performance scores that may be developed. Where appropriate, such performance metrics can be calculated as current/instantaneous values, maximum, minimum, average, or total over time, or using any other statistical analysis. Trends can also be determined, stored, and displayed to the user, the instructor, and/or other users. A user interface may be provided for the user to control the language, units, and other characteristics for the information displayed.

Aspects of a resistance apparatus (e.g., resistance apparatus 110, resistance mechanism 326, etc.) for use with the asymmetrical flywheel of the present disclosure will now be described in greater detail with reference to FIGS. 4A-G. The resistance apparatus 400 includes an arm 410 to be disposed around a periphery of a flywheel, with one end attached to a rod, such as stepper motor lead screw 422. In the illustrated embodiment, the resistance apparatus 400 is attached to the stepper motor lead screw 422 through a ball joint assembly or other appropriate connection hardware. The stepper motor 420 is threadedly engaged with the lead screw 422 and configured to rotate its threaded member thereby moving the lead screw, and correspondingly the resistance apparatus 400, up and down.

The stepper motor 420, may be attached at a fixed location on the exercise device (e.g., attached to the frame of the exercise apparatus, a mounting bracket attached to the exercise apparatus, etc.). In operation, the stepper motor 420 is driven to move the lead screw 422 up and down. The corresponding movement of the arm 410 relative to the flywheel, causes a change in resistance applied to the flywheel. The resistance is applied via magnetic flux between one or more pairs of magnetic members 440 and a backing plate 450 disposed on the arm 410 and the flywheel and braking track, and the resistance changes as the arm 410 moves closer to or away from the flywheel. In a first position, the magnets in the arm 410 are maintained in a position above (and/or laterally away from) the flywheel, providing minimal resistance on the flywheel. In a second position, the magnets in the arm 410 are positioned to face an outer portion of the flywheel, thereby maximizing magnetic resistance during exercise. The position of the magnets relative to the flywheel, the resistance applied to the flywheel, and/or other parameters may be sensed through one or more sensors (not shown) provided on the exercise apparatus. A user may be provided with a single knob that may be rotated to control the stepper motor 420 or other controls (e.g., buttons, knobs, touchscreen display, etc.) to adjust the resistance apparatus and the corresponding resistance applied to the flywheel.

In some embodiments, the resistance force is measured via a load cell, which may include a low cost, high precision load cell operable to measure forces generated directly within the resistance mechanism. Resistance force can be used with a measured flywheel speed to accurately calculate user power output. In one embodiment, the actuator may comprise a 35 mm permanent magnet, non-captive, linear stepper motor to actuate the resistance mechanism. In various embodiments, the load cell may include a low-cost aluminum, single point load cell, arranged such that the load cell is the only member connecting the magnet holding bracket to the rest of the braking mechanism. The stepper motor may include an integrated stepper driver with current control. In some embodiments, a stepper motor operable at 12v, 500-900 mA may be used. Microstepping may be used for smooth and quiet operation.

In the illustrated embodiments, the resistance magnets include 6 resistance magnets arranged in 3 corresponding magnet pairs (or other paired arrangement). Each magnet may be, for example, 25 mm diameter, 8 mm thick sintered Neodymium rare earth magnets, grade N32. The resistance apparatus may include a magnet holder that is formed in one piece, machined and bent into shape for use as described herein.

Various embodiments of electrical components for use in an exercise apparatus with a braking system disclosed herein will now be described with reference to FIG. 5. In various embodiments, logical components are operable to evaluate the load cell signals and adjust for noise, accuracy, precision, resolution and/or drift throughout a workout. The logical components may include a calibration procedure, power calculation method, reporting of data to a display, tablet or other connected device, and/or other features associated with the operation of the exercise apparatus. The logical components may also function to evaluate and tune the actuator assembly motion, accuracy, speed and audible noise. In some embodiments, communication with a tablet or display may be facilitated across a wired (e.g., using RS-232 standard) or wireless communications (e.g., Bluetooth, WiFi, etc.) standard. The logical components may include a "go to resistance" option directing the stepping motor/actuator to adjust the resistance until a desired resistance is sensed.

Figure 5:
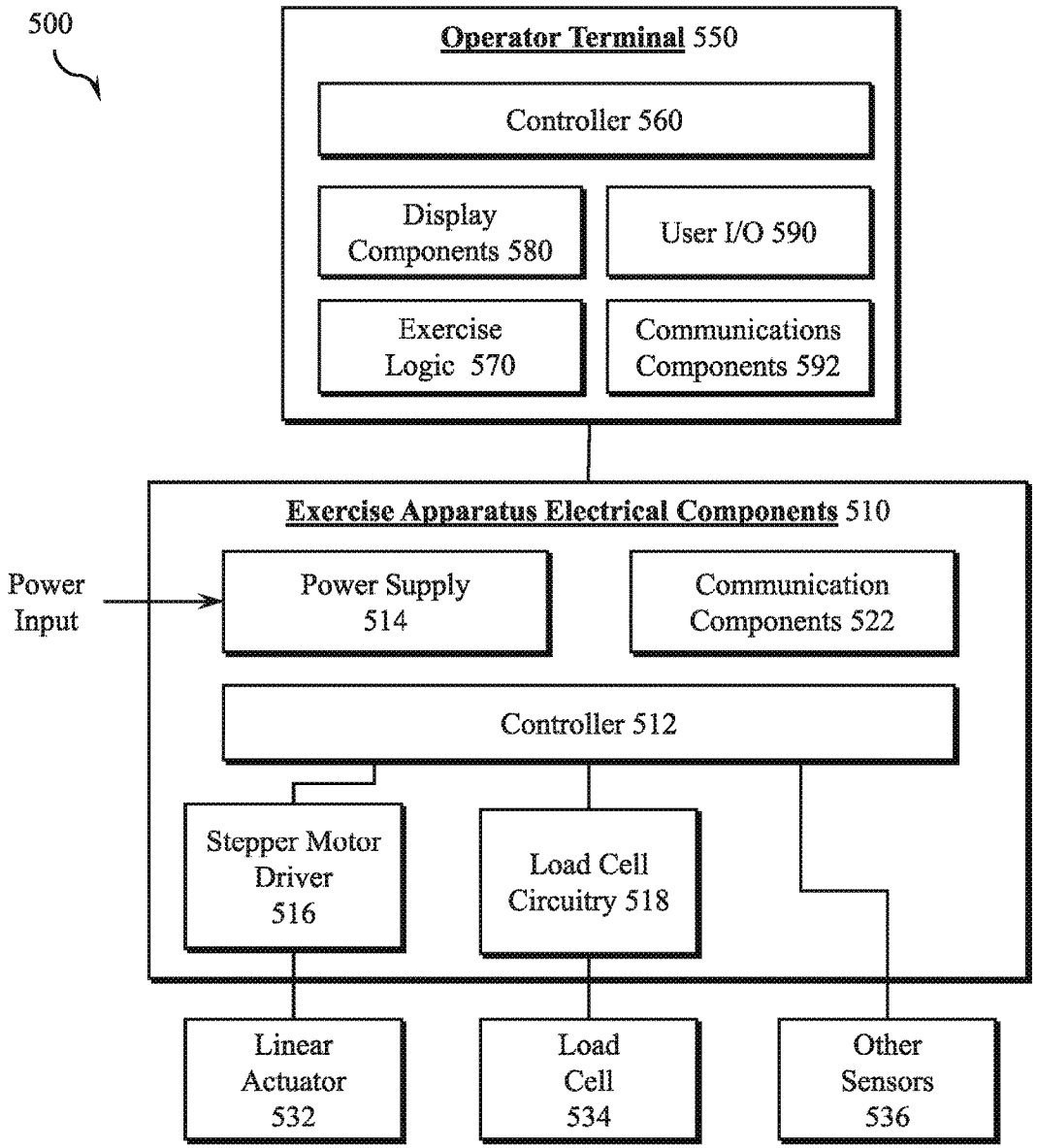
FIG. 5 is a block diagram illustrating electrical components for use in an exercise apparatus implementing an asymmetrical resistance system in accordance with one or more embodiments of the present disclosure.

FIG. 5 illustrates electrical and processing components for an example exercise apparatus in accordance with various embodiments of the present disclosure. A system 500 includes exercise apparatus electrical components 510 and an operator terminal 550. The exercise apparatus electrical components 510 facilitate the operation of an exercise apparatus, including communications with the operator terminal 550, controlling various components (e.g., a linear actuator), and receiving and processing sensor data.

In various embodiments, the exercise apparatus electrical components 510 include a controller 512, power supply 514, communications components 522, a stepper motor driver 516 for controlling the linear actuator 532, load cell circuitry 518 (e.g., PGA and/or ADC) for receiving a signal from load cell 534 and conditioning the signal, and interfaces with other sensors 536, which may include sensors for detecting flywheel RPMs and/or sensors for measuring changes in knob positon in response to user adjustments as disclosed herein.

The controller 512 may be implemented as one or more microprocessors, microcontrollers, application specific integrated circuits (ASICs), programmable logic devices (PLDs) (e.g., field programmable gate arrays (FPGAs), complex programmable logic devices (CPLDs), field programmable systems on a chip (FPSCs), or other types of programmable devices), or other processing devices used to control the operations of the exercise apparatus.

Communications components 522 may include wired and wireless interfaces. Wired interfaces may include communications links with the operator terminal 550, and may be implemented as one or more physical networks or device connect interfaces. Wireless interfaces may be implemented as one or more WiFi, Bluetooth, cellular, infrared, radio, and/or other types of network interfaces for wireless communications, and may facilitate communications with the operator terminal, and other wireless devices. In various embodiments, the controller 512 is operable to provide control signals and communications with the operator terminal 550.

The operator terminal 550 is operable to communicate with and control the operation of the exercise apparatus electrical components 510 in response to user input. The operator terminal 550 includes a controller 560, control logic 570 (e.g., for exercise and/or user control), display components 580, user input/output components 590, and communications components 592.

The controller 560 may be implemented as one or more microprocessors, microcontrollers, application specific integrated circuits (ASICs), programmable logic devices (PLDs) (e.g., field programmable gate arrays (FPGAs), complex programmable logic devices (CPLDs), field programmable systems on a chip (FPSCs), or other types of programmable devices), or other processing devices used to control the operator terminal. In this regard, controller 560 may execute machine readable instructions (e.g., software, firmware, or other instructions) stored in a memory.

Exercise control logic 570 may be implemented as circuitry and/or a machine readable medium storing various machine readable instructions and data. For example, in some embodiments, exercise control logic 570 may store an operating system and one or more applications as machine readable instructions that may be read and executed by controller 560 to perform various operations described herein. In some embodiments, exercise control logic 570 may be implemented as non-volatile memory (e.g., flash memory, hard drive, solid state drive, or other non-transitory machine readable mediums), volatile memory, or combinations thereof. The exercise control logic 570 may include status, configuration and control features which may include various control features disclosed herein. In some embodiments, the exercise control logic 570 executes an exercise class (e.g., live or archived) which may include an instructor and one or more other class participants. The exercise class may include a leaderboard and/or other comparative performance parameters for display to the user during the the exercise class.

Communications components 592 may include wired and wireless interfaces. A wired interface may be implemented as one or more physical network or device connection interfaces (e.g., Ethernet, and/or other protocols) configured to connect the operator terminal 550 with the exercise apparatus electrical components 510. Wireless interfaces may be implemented as one or more WiFi, Bluetooth, cellular, infrared, radio, and/or other types of network interfaces for wireless communications.

Display 580 presents information to the user of operator terminal 550. In various embodiments, display 580 may be implemented as an LED display, a liquid crystal display (LCD), an organic light emitting diode (OLED) display, and/or any other appropriate display. User input/output components 590 receive user input to operate features of the operator terminal 550.

In various embodiments, an exercise system incorporating the asymmetrical flywheel braking system disclosed herein may include one or more exercise apparatuses including one or more stationary bicycles, rowing machines, elliptical trainers, treadmills, and/or other exercise apparatuses, and the electrical and processing components may facilitate individual and/or group exercise sessions such as disclose in U.S. Pat. Nos. 9,174,085 and 11,400,344, which are incorporated by reference herein in their entirety.

Figure 6:
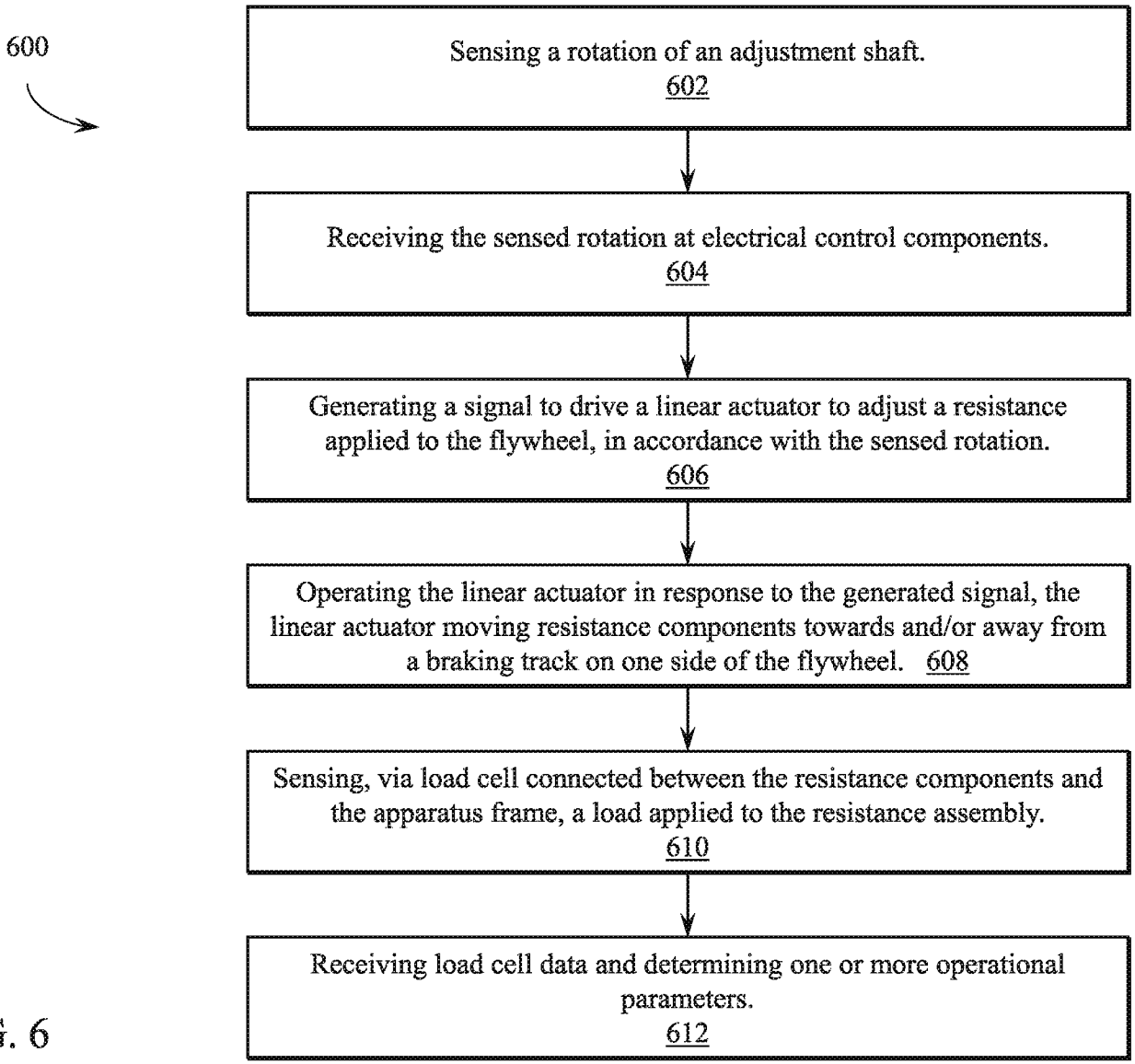
Figure 7C:
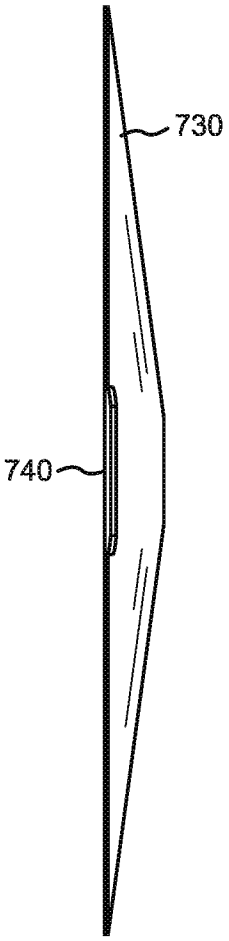
FIG. 7C is a top view of a cover for use with an asymmetrical resistance system, in accordance with one or more embodiments of the present disclosure.
Figure 7B:
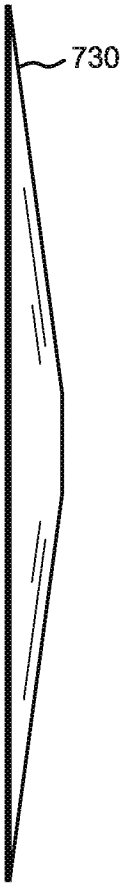
FIG. 7B is a bottom view of a cover for use with an asymmetrical resistance system, in accordance with one or more embodiments of the present disclosure.
Figure 7A:
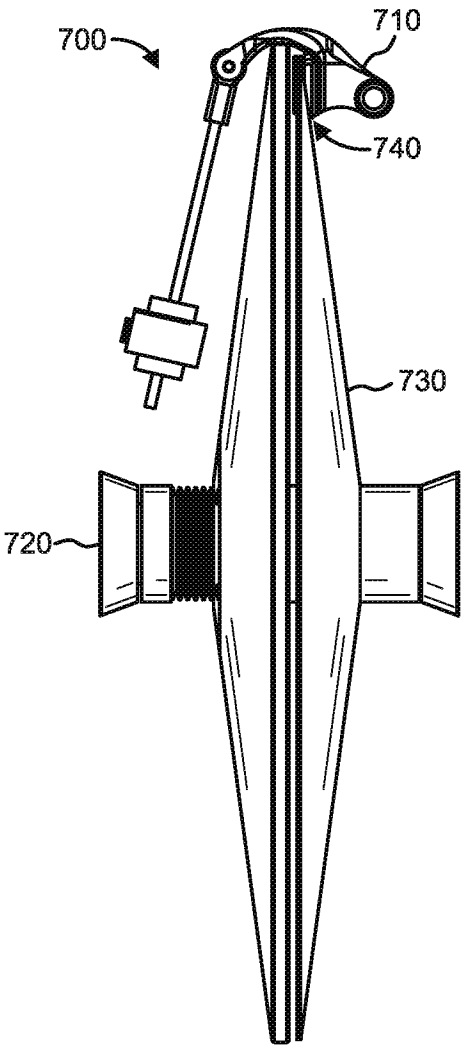
FIG. 7A is a side view of a cover for use with an asymmetrical resistance system, in accordance with one or more embodiments of the present disclosure.
Figure 7D:
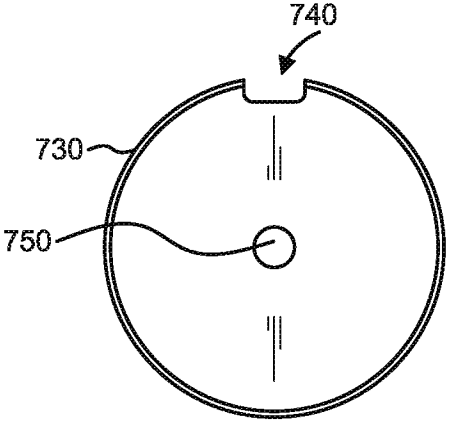
FIG. 7D is a rear view of a cover for use with an asymmetrical resistance system, in accordance with one or more embodiments of the present disclosure.
Figure 7E:
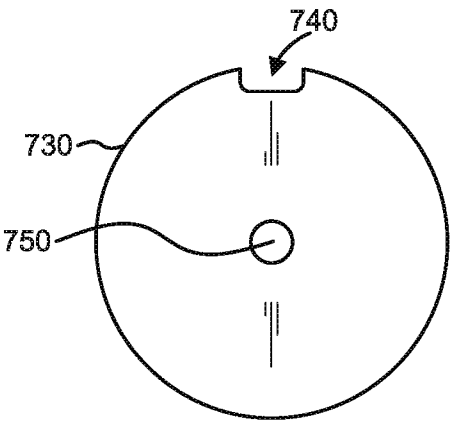
FIG. 7E is a front view of a cover for use with an asymmetrical resistance system, in accordance with one or more embodiments of the present disclosure.
Figure 7F:
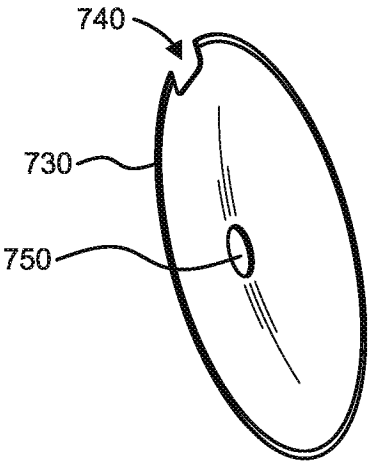
FIG. 7F is a rear perspective view of a cover for use with an asymmetrical resistance system, in accordance with one or more embodiments of the present disclosure.
Figure 7G:
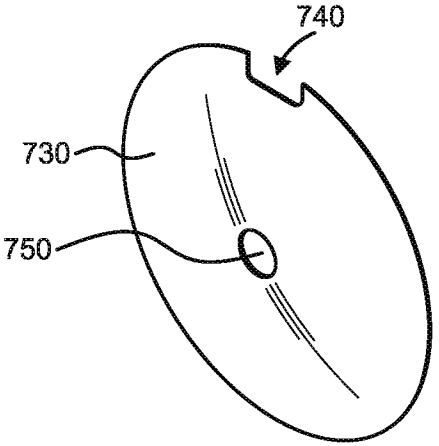
FIG. 7G is a front perspective view of a cover for use with an asymmetrical resistance system, in accordance with one or more embodiments of the present disclosure.

Referring to FIG. 6, a process 600 for operating a resistance system in accordance with embodiments of the present disclosure will now be described. In step 602, a rotation of an adjustment shaft is sensed using a brake encoder and received by the electrical control components (step 604). In accordance with the sensed rotation, the electrical control components generate a signal to drive an actuator to adjust the resistance applied to the flywheel (step 606). The actuator is then operated in response to the generated signal to vary resistance by moving resistance components towards and/or away from a braking track on one side of the flywheel (step 608). A load cell may be connected between the resistance components and the frame to sense a load applied to the resistance apparatus (step 610). The load cell data is received by the electrical control components and one or more operational parameters is determined (step 612), such as instantaneous power or a measure of resistance applied to flywheel.

In an example system, a processing system is configured to receive and process signals from a plurality of sensors and/or components of an exercise apparatus and facilitate communications between components and a computing device. The processing system may be electrically connected to a rotary encoder, which is configured to sense rotation of a brake adjustment shaft, a load cell configured to measure the force being applied to the flywheel by a magnetic braking assembly, a hall effect sensor, which may be disposed to track rotation of a flywheel (e.g., speed of rotation), and a stepper motor, which provides information regarding a current brake position.

In operation, the processing system may calculate RPM and cadence metrics by tracking the rate of rotation of the flywheel a sensor, for example, receiving data from the hall effect sensor which is configured to calculate the RPMs of the exercise apparatus during operation. The hall effect sensor may be disposed in a fixed position on the exercise apparatus to sense a magnet on the flywheel with each revolution of the flywheel.

The processing system also tracks sensor data from the load cell which operates at a predetermined sample rate and measures the force being applied to the flywheel by the magnetic braking assembly. The force measurements from the load cell may be used to calculate power and other criteria (e.g., power may be calculated as a function of the force derived from the load cell and the speed (or other rate calculation) of the flywheel calculated from the RPM data).

In various embodiments, the resistance apparatus is set up using a calibration routine, which determines the calibration steps. In some embodiments, the resistance apparatus is positioned to a first position at an edge of the flywheel and measurements are taken (e.g., load cell) or positions are tracked (e.g., stepper motor position). The resistance applied during operation of the exercise apparatus is calculated based on sensed load cell value and the values stored in the table. In one embodiment, upon power-up the computing system (e.g., the tablet, control unit or other processing device) checks for a valid load cell table in memory. If a table exists, then a standard homing procedure is conducted. If a valid table is not found in memory, then the calibration routine is executed to build a new table and store the new table in memory. Using the table, a current load cell reading can be used to calculate a position/offset by interpolating from the position information from the table. In some embodiments, load cell zeroing is performed at or near the beginning of an exercise session (e.g., to address drift over time).

The processing system may further be configured to operate the stepper motor including initialize, configure and drive the stepper motor to provide positional control of the resistance apparatus. As previously discussed, the stepper motor position is used to populate an offset table of position values and load cell measurement values. The homing routine may touch the brake mechanism to the edge of the flywheel to achieve homing. The homing routine may be used to determine the upper and lower limit of the range of motion of the brake. Stepper motor position may be counted as steps up and away from contact between the magnet holder and the edge of the flywheel. The stepper motor position may be used to determine a location value of the resistance apparatus in units of full steps. For example, a scale of 0 to 1000 steps may be used, where 1000 is when the brake contacts the flywheel and 0 is near the top of the range of the travel during operation. In some embodiments, the stepper motor is configured to operate between positions 0 and a value that is less than 1000 (e.g., 750) to avoid contact with the flywheel and to match an operational range of the exercise apparatus. In one or more embodiments, a computing system is configured to provide instructions to a stepper motor, including generating a "Drive to Position" command. For example, when a resistance setting is desired (e.g., as set by a user or controlled by the exercise apparatus in accordance with a terrain feature) a corresponding target position is determined and a drive to position command is issued. The stepper motor is configured to receive the "Drive to Position" command, including the desired position value, and command the stepper motor to execute a corresponding number of steps between a current position and the target position. The resistance may be converted into a position using a reverse lookup from the offset table. The command should then be used to drive to position using a smooth motion control profile for a desirable user experience.

In some embodiments, a matching cover is provided to provide a symmetrical look and protect the flywheel, magnets and parts from outside elements. Referring to FIGS. 7A-G, a cover 730 may be formed out of plastic or constructed of other materials as appropriate and includes a hole 750 formed in the middle for receiving the flywheel hub 720 (such as hub 128), and a notch 740 formed in the top to provide clearance for the resistance apparatus 710. In the illustrated embodiment, the cover 730 is attached in a fixed position, allowing the flywheel 700 to spin in relation thereto. In some embodiments, the cover 730 may be attached to the hub 720 and/or flywheel 700 and spins with the flywheel 700 during operation. In this embodiment, the cover 730 may be formed without the notch 740 and the diameter of the cover may be smaller than the diameter of the flywheel to provide clearance of the resistance apparatus 710.

Figure 8A:
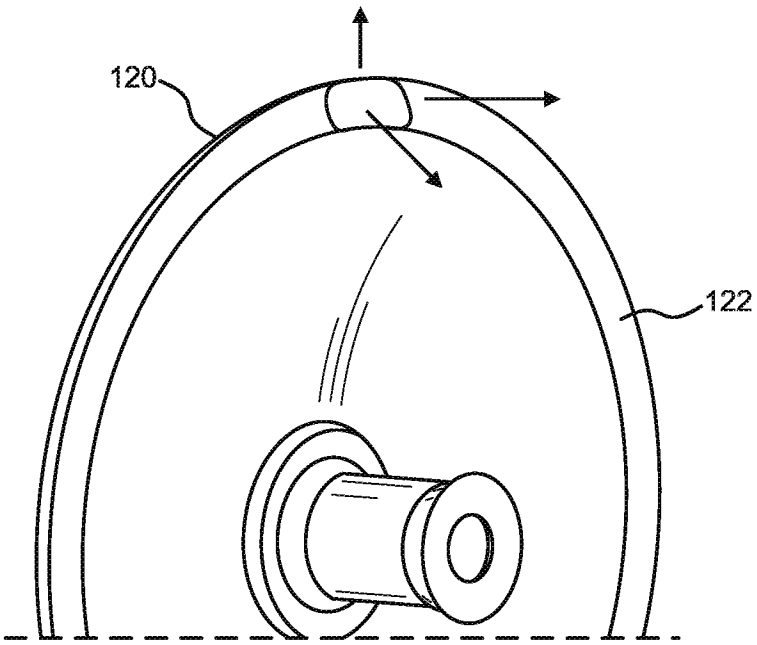
FIG. 8A illustrates various modes of operation for adjusting resistance in an asymmetrical resistance system, in accordance with one or more embodiments of the present disclosure.
Figure 8B:
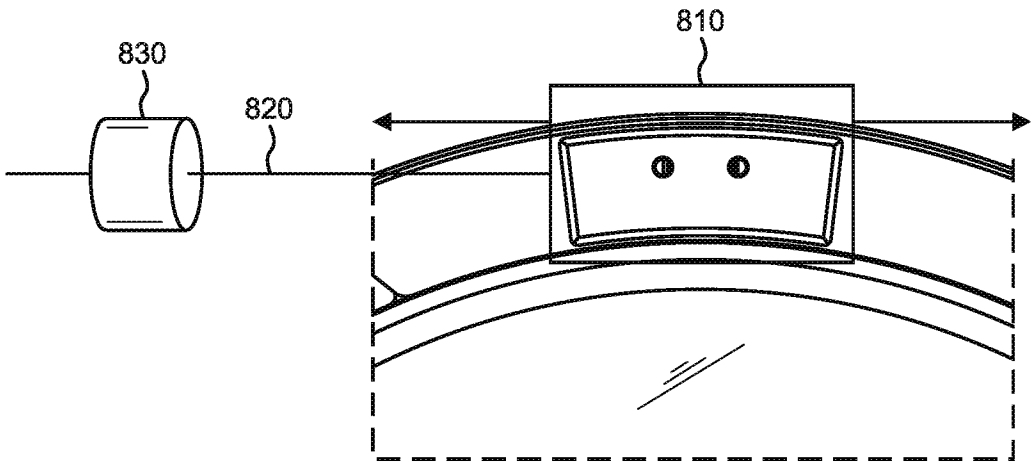
FIG. 8B illustrates a linear arrangement for adjusting resistance in an asymmetrical resistance system, in accordance with one or more embodiments of the present disclosure.
Figure 8D:
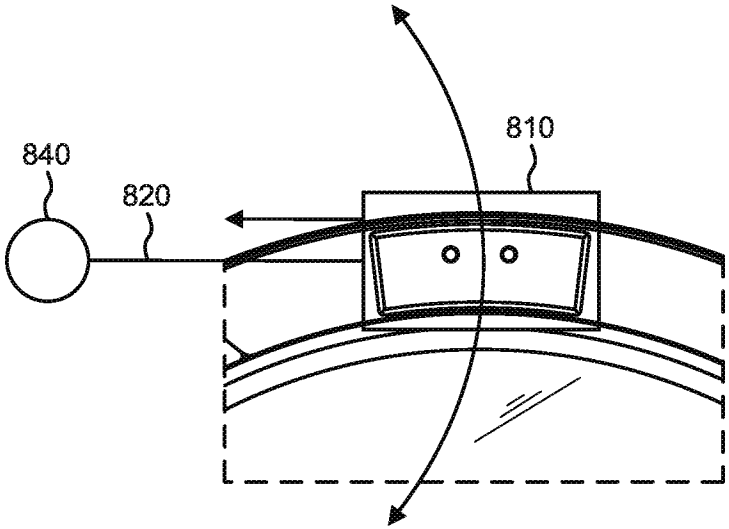
FIG. 8D illustrates an arcing arrangement for adjusting resistance in an asymmetrical resistance system, in accordance with one or more embodiments of the present disclosure.
Figure 8C:
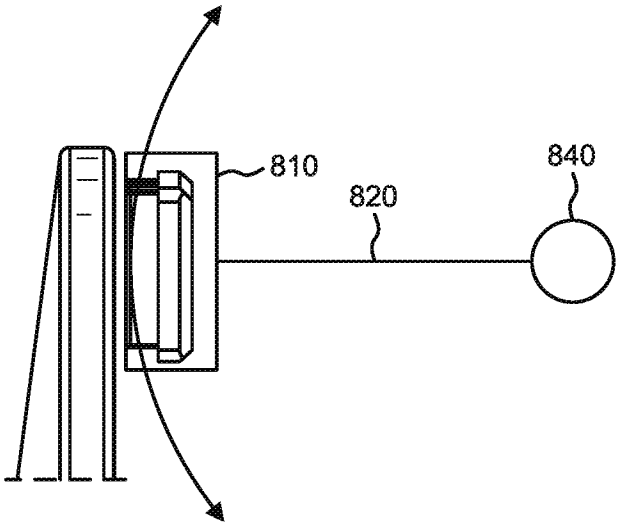
FIG. 8C illustrates an arcing arrangement for adjusting resistance in an asymmetrical resistance system, in accordance with one or more embodiments of the present disclosure.
Figure 8E:
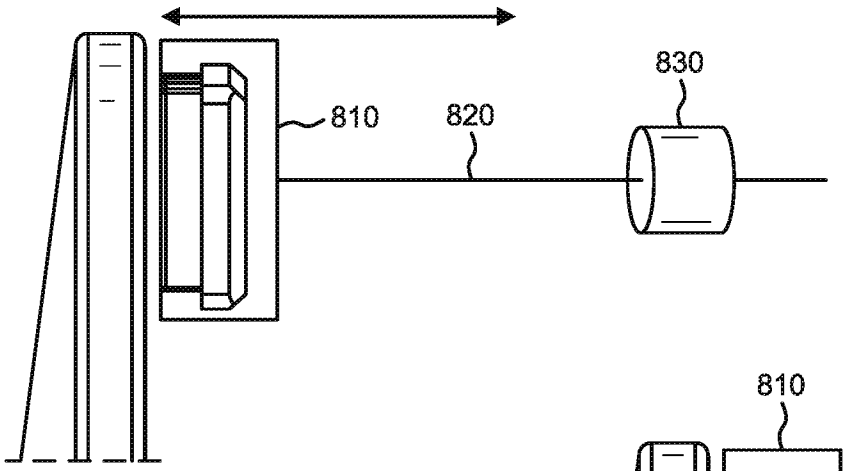
FIG. 8E illustrates a linear arrangement for adjusting resistance in an asymmetrical resistance system, in accordance with one or more embodiments of the present disclosure.
Figure 8F:
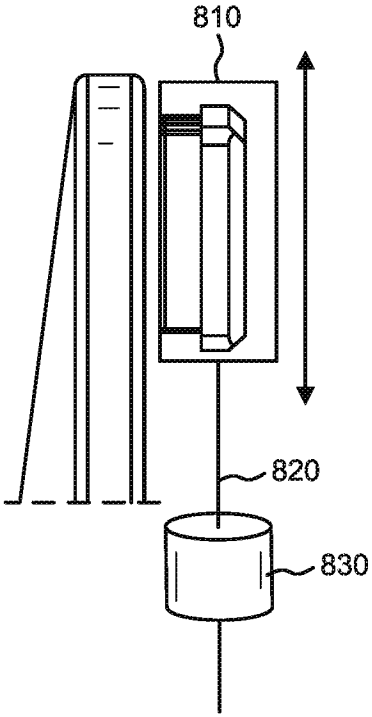
FIG. 8F illustrates a linear arrangement for adjusting resistance in an asymmetrical resistance system, in accordance with one or more embodiments of the present disclosure.
Figure 8G:
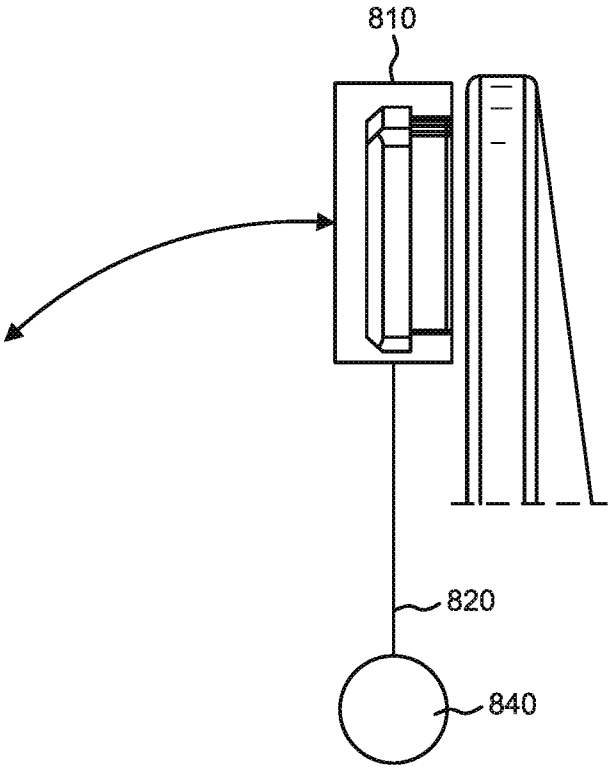
FIG. 8G illustrates an arcing arrangement for adjusting resistance in an asymmetrical resistance system, in accordance with one or more embodiments of the present disclosure.
Figure 8I:
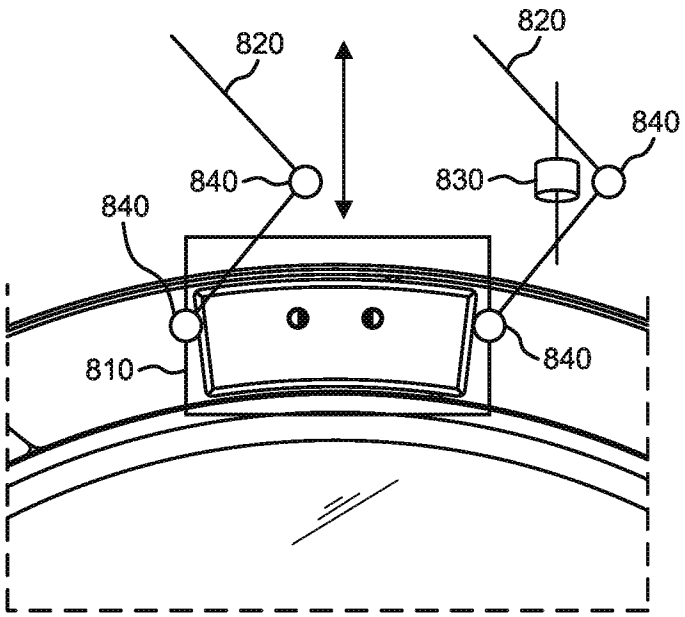
FIG. 8I illustrates a linkage arrangement for adjusting resistance in an asymmetrical resistance system, in accordance with one or more embodiments of the present disclosure.
Figure 8H:
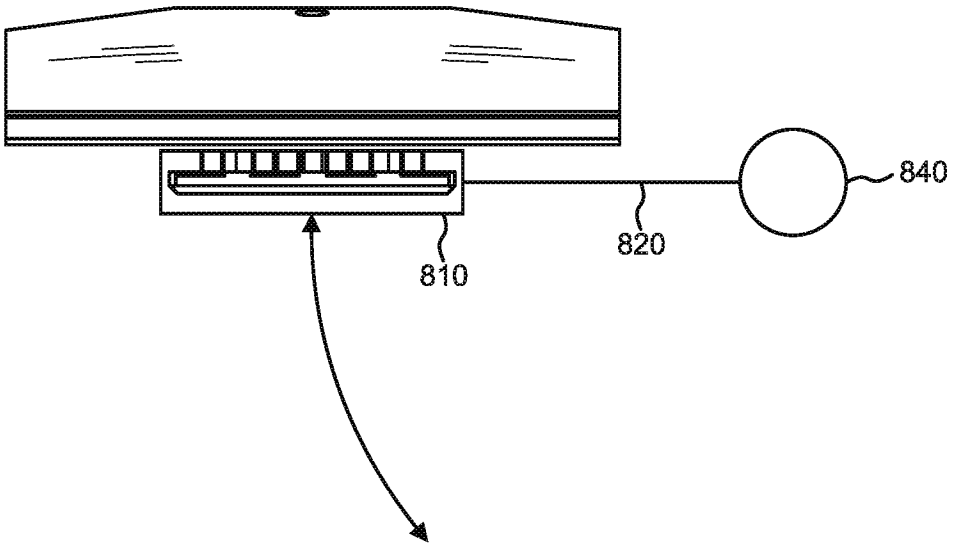
FIG. 8H illustrates an arcing arrangement for adjusting resistance in an asymmetrical resistance system, in accordance with one or more embodiments of the present disclosure.
Figure 8J:
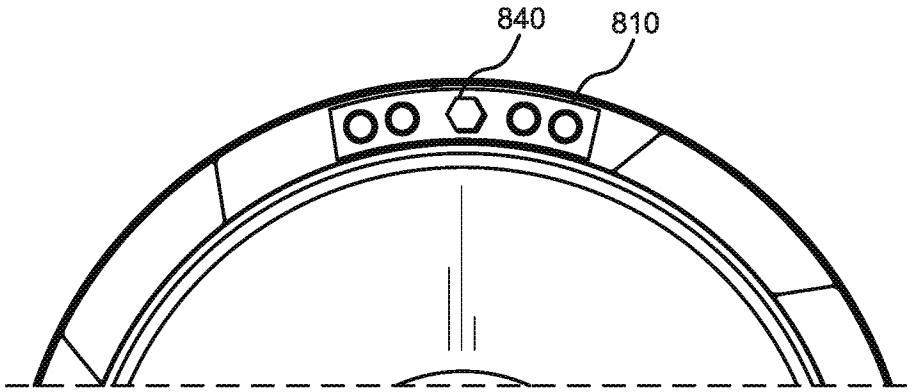
FIGS. 8J and 8K illustrate a rotating resistance adjustment arrangement for an asymmetrical resistance system, in accordance with one or more embodiments of the present disclosure.
Figure 8K:
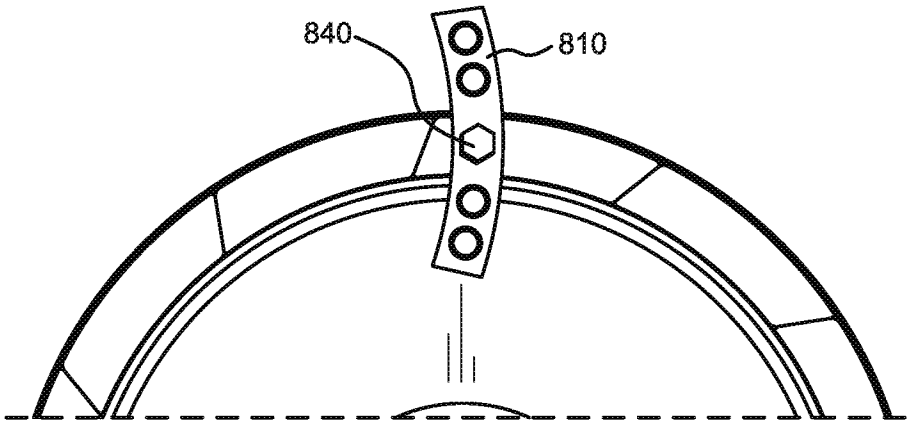

Referring to FIGS. 8A-K, various embodiments of resistance assemblies and actuator configurations will now be described. Various resistance assemblies 810 and actuator 830 configurations (including linkage 820) may be used that provide appropriate movement to move the resistance apparatus between a first position away from the flywheel where resistance is minimal (e.g., zero resistance from the magnets) to a second position close to the flywheel to provide effective resistance, with various intermediate steps for adjusting the resistance. For example, the magnets may be moved linearly up/down relative to the flywheel (FIG. 8F), rotated up/down in an arcing path about a pivot point 840 (FIGS. 8C & 8D), moved linearly fore/aft across the top of the flywheel (FIG. 8B), moved in/out from the face of the aluminum plate (FIG. 8E), rotated in/out from the face of the aluminum braking track in an arcing path about a pivot point 840 (FIG. 8G), rotated from a fixed position relative to the flywheel (FIGS. 8J & 8K), or moved through other methods. In some embodiments, multi-pivot linkage designs may also be used (FIG. 8I). In various embodiments, the movement may be manual or electrical, and include one or more sensors or other measurement approaches to track a resistance value.

The foregoing disclosure is not intended to limit the present invention to the precise forms or particular fields of use disclosed. As such, it is contemplated that various alternate embodiments and/or modifications to the present disclosure, whether explicitly described or implied herein, are possible in light of the disclosure. Having thus described embodiments of the present disclosure, persons of ordinary skill in the art will recognize advantages over conventional approaches and that changes may be made in form and detail without departing from the scope of the present disclosure.

What is claimed is:

1. A resistance system comprising:

a flywheel configured to be rotatably mounted to an exercise apparatus, the flywheel being substantially cone-shaped and configured to rotate about a hub, the flywheel having an outer portion adjacent to a perimeter of the flywheel, the outer portion comprising a first ferromagnetic material;

a braking track disposed on a first side of the flywheel on or adjacent to the outer portion, the braking track comprising a second ferromagnetic material; and a resistance apparatus configured to be mounted to the exercise apparatus, the resistance apparatus comprising:

at least one pair of magnets having a front side configured to face the braking track when the resistance apparatus is in a first position; and a backing plate comprising a third ferromagnetic material, the backing plate disposed on a second side of the at least one pair of magnets opposite the front side when the resistance apparatus is in the first position.

2. The resistance system of claim 1, wherein the resistance apparatus further comprises an actuator configured to selectively position the resistance apparatus relative to the braking track of the flywheel; and wherein the actuator is configured to selectively position the resistance apparatus in the first position to apply a force resistant to rotation of the flywheel.

3. The resistance system of claim 2, wherein the actuator is configured to selectively position the resistance apparatus in a second position wherein the at least one pair of magnets is further away from the braking track than the first position, and wherein the force resistant to rotation of the flywheel in the second position is less the force applied in the first position.

4. The resistance system of claim 1, wherein the resistance system is an asymmetrical resistance system configured to apply the force resistant to rotation of the flywheel on only one side of the flywheel;

wherein a second side of the flywheel, opposite the first side of the flywheel, does not include the braking track; and wherein magnets are not disposed on the second side of the flywheel.

5. The resistance system of claim 1, wherein the braking track is disposed on the outer portion of the flywheel, between the at least one pair of magnets and the outer portion, when the resistance apparatus is in the first position;

wherein a magnetic field forms from a first magnet to the outer portion of the flywheel through the braking track, back through the braking track to a second magnet, and from the second magnet through the backing plate to the first magnet; and wherein during rotation of the flywheel, the braking track moves through the magnetic field creating an eddy current that applies force to resist the rotation of the flywheel.

6. The resistance system of claim 1, wherein the resistance system further comprises a flywheel cover having substantially the same shape as the flywheel and positioned to face a concave side of the flywheel.

7. The resistance system of claim 1, further comprising an actuator and a linkage connecting the actuator to the resistance apparatus, wherein the actuator is configured to move the resistance apparatus to a first position where the at least one pair of magnets is proximate to the braking track such that resistance is applied to the flywheel, a second position where the at least one pair of magnets is a distance away from the braking track such that low resistance and/or no resistance is applied to the flywheel, and at least one intermediate position.

8. The resistance system of claim 7, wherein the actuator and linkage are configured to selectively move the resistance apparatus in a linear and/or arcing path, wherein the path comprises movement side-to-side relative to the flywheel, up-and-down relative to the flywheel, and/or towards-and-away from the flywheel.

9. The resistance system of claim 7, wherein the actuator and linkage are configured to selectively rotate the resistance apparatus about an axis perpendicular to the braking track of the flywheel;

wherein in a first position of rotation the at least one pair of magnets are positioned away from the braking track; and wherein in a second position of rotation the at least one pair of magnets are positioned adjacent to the braking track.

10. The resistance system of claim 1, wherein the outer portion comprises steel and wherein the braking track comprises aluminum.

11. An exercise system comprising the resistance system of claim 1, the exercise system comprising:

a frame;

the flywheel rotatably connected to the frame and configured to facilitate rotation during operation of the exercise apparatus; and the resistance apparatus connected to the frame and configured to selectively apply resistance to the flywheel by forming a magnetic field from a first magnet to the outer portion of the flywheel through the braking track, back through the braking track to a second magnet, and from the second magnet through the backing plate to the first magnet; and wherein during operation of the exercise apparatus, the braking track is rotated through the magnetic field to create an eddy current that applies force to resist the rotation of the flywheel.

12. A method for operating the exercise system of claim 11, comprising:

moving the resistance apparatus from a second position wherein the at least one pair of magnets is further away from the braking track than the first position to the first position where the at least one pair of magnets is adjacent to the braking track;

forming the magnetic field from the first magnet to the outer portion of the flywheel through the braking track, back through the braking track to the second magnet, and from the second magnet through the backing plate to the first magnet; and rotating the braking track through the magnetic field to create the eddy current that applies force to resist the rotation of the flywheel.

13. A method for adjusting resistance in an exercise apparatus, the method comprising:

facilitating rotation of a flywheel, the flywheel being substantially cone-shaped and configured to rotate about a hub, the flywheel having an outer portion adjacent to a perimeter of the flywheel and a braking track disposed on a first side of the flywheel on or adjacent to the outer portion, the outer portion comprising a first ferromagnetic material and the braking track comprising a second ferromagnetic material;

selectively positioning a pair of magnets between a first position where the pair of magnets are adjacent to the braking track and a second position where the pair of magnets are further away from the braking track than the first position; and wherein a magnetic field is formed when the pair of magnets are in the first position, the magnet field forming from a first magnet of the pair of magnets to the outer portion of the flywheel through the braking track, back through the braking track to a second magnet of the pair of magnets, and from the second magnet through a backing plate to the first magnet;

wherein rotation of the flywheel causes the braking track to rotate through the magnetic field to create an eddy current that applies force to resist the rotation of the flywheel; and wherein the force resistant to rotation of the flywheel is applied on the first side of the flywheel.

14. The method of claim 13, wherein a distance between the pair of magnets and the braking track corresponds to a resistance applied to the flywheel.

15. The method of claim 13, wherein the braking track is disposed on the first side of the flywheel, and wherein a second side of the flywheel opposite the first side of the flywheel does not include the braking track and/or wherein no magnets are positioned on the second side of the flywheel.

16. An exercise system comprising:

a frame;

a substantially cone-shaped flywheel rotatably mounted to the frame and configured to rotate about a vertex, the flywheel having an outer portion adjacent to a perimeter of the flywheel, the outer portion comprising a first ferromagnetic material;

a braking track disposed on a first side of the flywheel on or adjacent to the outer portion and opposite the vertex, the braking track comprising a second ferromagnetic material;

a resistance apparatus mounted to the frame and moveable between at least a first position and a second position relative to the flywheel, the resistance apparatus comprising:

at least one pair of magnets configured to face the braking track when the resistance apparatus is in the first position;

a backing plate disposed on a second side of the at least one pair of magnets opposite a facing side when the resistance apparatus is in the first position; and wherein, in the first position, a magnetic field forms to apply a force resistant to rotation of the flywheel on the first side of the flywheel.

17. The exercise system of claim 16, wherein the resistance apparatus further comprises an actuator configured to selectively position the at least one pair of magnets relative to the braking track of the flywheel;

wherein the actuator is configured to selectively position the at least one pair of magnets in the second position wherein the at least one pair of magnets is further away from the braking track than in the first position, and wherein the force resistant to rotation of the flywheel in the second position is less than the force applied in the first position; and wherein the actuator is configured to selectively move the at least one pair of magnets in an arcing path side-to-side relative to the flywheel, up-and-down relative to the flywheel, and/or towards-and-away from the flywheel.

18. The exercise system of claim 16, wherein a second side of the flywheel, opposite the first side of the flywheel, does not include the braking track;

wherein magnets are not disposed on the second side of the flywheel; and wherein the force resistant to rotation of the flywheel is applied on only the first side of the flywheel.

19. The exercise system of claim 16, wherein during rotation of the flywheel, the braking track moves through the magnetic field creating an eddy current that applies force to resist the rotation of the flywheel.

20. The exercise system of claim 16, further comprising an exercise cycle, a rowing machine, an elliptical trainer, or a treadmill configured for a user of the exercise system to drive rotation of the flywheel; and a control system configured to instruct the resistance apparatus to adjust resistance applied to the flywheel.

* * * * *